US006915848B2

(12) United States Patent
Thomeer et al.

(10) Patent No.: US 6,915,848 B2
(45) Date of Patent: Jul. 12, 2005

(54) UNIVERSAL DOWNHOLE TOOL CONTROL APPARATUS AND METHODS

(75) Inventors: Hubertus V. Thomeer, Houston, TX (US); Zheng Rong Xu, Sugar Land, TX (US); Sarmad Adnan, Sugar Land, TX (US); Michael H. Kenison, Missouri City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 10/208,462

(22) Filed: Jul. 30, 2002

(65) Prior Publication Data

US 2004/0020643 A1 Feb. 5, 2004

(51) Int. Cl.[7] ..... E21B 42/00

(52) U.S. Cl. ..... 166/250.11; 166/250.12; 175/40

(58) Field of Search ..... 166/250.11, 250.12, 166/387; 175/40

(56) References Cited

U.S. PATENT DOCUMENTS

| | | | |
|---|---|---|---|
| 4,023,167 | A | 5/1977 | Wahlstrom |
| 4,572,293 | A | 2/1986 | Wilson et al. |
| 4,578,675 | A | 3/1986 | MacLeod |
| 4,630,044 | A | 12/1986 | Polzer |
| 4,656,463 | A | 4/1987 | Anders et al. |
| 4,684,946 | A | 8/1987 | Issenmann |
| 4,763,520 | A | 8/1988 | Titchener et al. |
| 4,827,395 | A | 5/1989 | Anders et al. |
| 4,968,978 | A | 11/1990 | Stolarczyk |
| 4,980,682 | A | 12/1990 | Klein et al. |
| 4,992,787 | A | 2/1991 | Helm |
| 5,144,298 | A | 9/1992 | Henneuse |
| 5,160,925 | A | 11/1992 | Dailey et al. |
| 5,189,415 | A | 2/1993 | Shimada et al. |
| 5,268,683 | A | 12/1993 | Stolarczyk |
| 5,279,366 | A | 1/1994 | Scholes |
| 5,350,018 | A | 9/1994 | Sorem et al. |
| 5,361,383 | A | 11/1994 | Chang et al. |
| 5,363,094 | A | 11/1994 | Staron et al. |
| 5,394,141 | A | 2/1995 | Soulier |

(Continued)

FOREIGN PATENT DOCUMENTS

| | | | |
|---|---|---|---|
| EP | 0 273 379 | A2 | 7/1988 |
| EP | 0 539 240 | A2 | 4/1993 |
| EP | 0 539 240 | A3 | 4/1993 |
| EP | 0 651 132 | A3 | 5/1995 |
| EP | 0 651 132 | A2 | 5/1995 |
| EP | 0 730 083 | A2 | 9/1996 |
| EP | 0 730 083 | A3 | 8/1998 |
| EP | 0848512 | A3 | 5/2000 |
| WO | WO 00/60780 | | 10/2000 |
| WO | WO 00/73625 | | 12/2000 |
| WO | 01/42622 | A1 | 6/2001 |
| WO | WO 01/92675 | A2 | 12/2001 |
| WO | WO-02/088618 | A1 | 11/2002 |

*Primary Examiner*—William Neuder
(74) *Attorney, Agent, or Firm*—Robin Nava; Wayne Kanak

(57) ABSTRACT

A method and apparatus for internal data conveyance within a well from the surface to a downhole tool or apparatus and for returning downhole tool data to the surface, without necessitating the provision of control cables and other conventional conductors within the well. One embodiment involves sending telemetry elements such as tagged drop balls or a fluid having specific chemical characteristics from surface to a downhole tool as a form of telemetry. The telemetry element or elements are provided with identification and instruction data, which may be in the form of data tags, such as RF tags or a detectable chemical constituent. The downhole tool or apparatus is provided with a detector and microcomputer and is capable of recognizing the telemetry element and communicating with it or carrying out instructions that are provided in the telemetry data thereof.

38 Claims, 14 Drawing Sheets

U.S. PATENT DOCUMENTS 5,457,447 A 10/1995 Ghaem et al.
5,467,083 A 11/1995 McDonald et al.
5,495,237 A 2/1996 Yuasa et al.
5,497,140 A 3/1996 Tuttle
5,512,889 A 4/1996 Fletcher
5,576,703 A 11/1996 MacLeod et al.
5,585,790 A 12/1996 Luling
5,626,192 A 5/1997 Connell et al.
5,680,459 A 10/1997 Hook et al.
5,682,143 A 10/1997 Brady et al.
5,720,345 A 2/1998 Price et al.
5,784,004 A 7/1998 Esfahani et al.
5,818,352 A 10/1998 McClure
5,904,210 A 5/1999 Stump et al.
5,945,923 A 8/1999 Soulier
5,959,548 A 9/1999 Smith
5,995,449 A 11/1999 Green et al.
6,025,780 A 2/2000 Bowers et al.
6,026,911 A 2/2000 Angle et al.
6,078,259 A 6/2000 Brady et al.
6,150,954 A 11/2000 Smith
6,333,699 B1 12/2001 Zierolf
6,333,700 B1 * 12/2001 Thomeer et al. ..... 340/854.8
6,343,649 B1 2/2002 Beck et al.
6,359,569 B2 3/2002 Beck et al.
6,408,943 B1 6/2002 Schultz et al.
6,443,228 B1 9/2002 Aronstam et al.
6,481,505 B2 11/2002 Beck et al.
6,497,280 B2 12/2002 Beck et al.
6,536,524 B1 3/2003 Snider
6,597,175 B1 7/2003 Brisco
2001/0054969 A1 * 12/2001 Thomeer et al. ..... 340/853.3
2002/0088620 A1 7/2002 Lerche et al.
2002/0158120 A1 10/2002 Zierolf
2002/0185273 A1 12/2002 Aronstam et al.
2003/0090390 A1 5/2003 Snider et al.

* cited by examiner

GENERAL LOGIC

"SET" LOGIC

"INJECTION" LOGIC

"INJECTION" LOGIC

"UNSET" LOGIC

UNIVERSAL DOWNHOLE TOOL CONTROL APPARATUS AND METHODS

BACKGROUND OF THE INVENTION

1. Field of the Invention

The present invention generally concerns the control of downhole apparatus in petroleum production wells for accomplishing a wide variety of control functions, without necessitating the presence of control cables, conductors in the well, or mechanical manipulators. The present invention broadly concerns a system or method that is employed to relay information from the surface to a downhole tool or well apparatus and to likewise relay information from downhole apparatus to the surface. More particularly, the present invention concerns the provision of apparatus located in the downhole environment which is operational responsive to predetermined instructions to perform predetermined well control functions, and one or more operation instruction devices which are provided with desired instructions and are moved through well tubing, such as coiled tubing, from the surface to close proximity with the downhole well control apparatus for transmission of the well control instructions to an antenna or other detector.

2. Description of the Related Art

Historically, one of the limiting factors of coiled tubing as a conveyance mechanism has been the lack of effective telemetry between the surface and the downhole tools attached to the coiled tubing. An example of a tool string that may be deployed on coiled tubing is described in U.S. Pat. No. 5,350,018, which is incorporated herein by reference. The tool string of the '018 patent communicates with the surface by means of an electrical conductor cable deployed in the coiled tubing. Some tools send go/no-go type data from a downhole tool to the surface by means of pressure pulses. Other tools are designed to be operated using push/pull techniques requiring highly skilled and experienced operators and often produce inconsistent results. Hence, a truly effective way to send information or instructions from the surface to a downhole coiled tubing tool has not yet been implemented. Since many wells have deviated or horizontal sections or multilateral branch bores, the use of coiled tubing is in many cases preferred for deploying and energizing straddle packers, casing perforators, and other well completion, production and treating tools, thus increasing the importance of effective communication between the surface and downhole tools.

BRIEF SUMMARY OF THE INVENTION

It is a primary feature of the present invention to provide a well control system enabling the control of various downhole well control functions by instructions from the surface without necessitating the well or downhole tool conveyance mechanism being equipped with electrical power and control cables extending from the surface to the downhole well control equipment and without the use of complex and inherently unreliable mechanical shifting or push/pull techniques requiring downhole movement controlled remotely from the surface.

It is another feature of the present invention to provide a well control system having downhole well control apparatus that is responsive to instructions from elements such as fluids or physical objects, including darts and balls that are embedded with tags for identification and for transmission of data or instructions, thereby allowing downhole tools to be controlled locally, rather than by direct link to the surface.

This specification describes methods of sending smart telemetry elements such as drop balls, darts, other small objects, or information transmitting fluid from the surface to a downhole tool as a form of telemetry to permit downhole activities to be carried out, without necessitating the provision of expensive and troublesome control cables and conductors in the well system. Issues pertaining to the process of reading these telemetry elements are identified herein, and solutions are provided as examples of surface to downhole telemetry systems embodying the principles of the present invention. Also included is a description of the important features and key components of an indexing valve that may be used in conjunction with the telemetry system.

This invention describes a method that can be used to relay information from the surface to downhole tools and/or for conveying data representing downhole conditions from downhole tools to the surface in preparation for well control activities. The information from surface may be used, for example, to request data (e.g. pressure or temperature) from the downhole tool or to send operating instructions to the tool.

This specification also describes how a telemetry system embodying the principles of the present invention may be used to control a valve in a downhole tool that directs the internal fluid flow through one or more ports. The valve itself, identified as an indexing valve, is within the scope of the invention. The present invention includes not only the sending and receiving of information between the surface and one or more downhole locations, but also includes the performance of subsequent actions in the downhole environment based on the information and without requiring subsequent instructions from the surface.

The present invention may be practiced by any or all of multiple types of shaped devices, (for example, balls, darts, or objects of other suitable geometry), sent or dropped downhole, carrying information to a downhole sensor to cause downhole tools or apparatus to activate an event. These shaped devices, regardless of their geometry, may be classified as Type I, II, or III, or combinations of Types I, II, and III.

A Type I internal telemetry device has an identification number or other designation corresponding to a predetermined event. Once a downhole sensor receives or detects the device identification number or code, the downhole sensor may or may not send a command uphole. A pre-programmed computer will perform a series of logical analyses and then activate a certain event, i.e., actuation of a downhole tool.

A Type II internal telemetry device has a reprogrammable memory that may be programmed at the surface with an instruction set which, when detected by a downhole sensor, causes a downhole tool to actuate according to the instruction set. The downhole device may also write information to the Type II tag for return to surface.

A Type III internal telemetry device has one or more embedded sensors. This type of device can combine two or more commands together. For example, a Type III device may have a water sensor embedded therein. After landing downhole, if water is detected, the Type III device issues a command corresponding to a downhole actuation event.

An internal telemetry device may include variations of Type I, II, and III devices and may detect downhole conditions of a well and, responsive to detection of certain designated conditions, provide control signals causing downhole apparatus, such as valves and packers, to be actuated and cause signals to be transmitted to the surface to confirm that the designated activities have taken place.

Another embodiment of the present invention involves the use of downhole receptacles such as are typically defined by side pocket mandrels commonly used in gas lift well production applications. With one or more side pocket mandrels in place, a programmed well control tool is conveyed downhole and is inserted into a selected pocket. Its identification and operational control codes are detected and utilized according to detected well conditions to accomplish downhole activities of various downhole apparatus, such as valves, packers, treatment tools, and the like. Additionally, the side pocket tool may have a data acquisition capability for recording downhole data that may be downloaded to computer equipment at the surface. Finally, the side pocket tool, responsive to well conditions and activities, may energize pulsing equipment and transmit signals via the fluid column to surface equipment.

BRIEF DESCRIPTION OF THE DRAWINGS

So that the manner in which the above recited features, advantages and objects of the present invention are attained may be understood in detail, a more particular description of the invention, briefly summarized above, may be had by reference to the embodiments thereof illustrated in the appended drawings, which drawings are incorporated as a part hereof.

It is to be noted, however, that the appended drawings illustrate only typical embodiments of the invention and are therefore not to be considered limiting of its scope, for the invention may admit to other equally effective embodiments.

In the Drawings:

FIG. 1 is a sectional view of a downhole tool having a tool chassis within which is located a sensor, such as a radio-frequency "RF" antenna and with protrusions within the flow passage of the tool chassis for controlled internal telemetry element movement through the RF antenna to permit accurate internal telemetry element sensing;

FIG. 1A is a sectional view taken along line 1A—1A of FIG. 1;

FIG. 1B is a logic diagram illustrating internal telemetry of a tagged object in a well to a reader or antenna and processing of the signal output of the reader or antenna along with data from downhole sensors to actuate a mechanical device and to cause pressure signaling to the surface for confirmation of completion of the instructed activity of the mechanical device;

FIG. 1C is a sectional view of a ball type internal telemetry element having a releasable ballast to permit descent thereof in a conveyance passage fluid and after release of the ballast to permit ascent thereof in a conveyance passage fluid for retrieval without fluid flow;

FIG. 1D is a sectional view of a tool chassis and sensor having an internal structure that forces a telemetry element therein to follow a helical path through the chassis;

FIG. 1E is a sectional view of a tool chassis and sensor having a secondary flow path through which a telemetry element is forced to pass;

FIG. 1F is a sectional view of a tool chassis and sensor having elastic fingers to slow the passage of a telemetry element therethrough;

FIG. 1G is a sectional view of a tool chassis and sensor having a solenoid-actuated protrusion in the flow path for delaying the passage of a telemetry element therethrough;

FIG. 1H is a sectional view of a tool chassis and sensor having a restricted diameter in the flow path for delaying the passage of a telemetry element therethrough, illustrated with a telemetry element in the "delay" position;

FIG. 1I is a sectional view of the tool chassis and sensor of FIG. 1H, illustrated after a telemetry element has passed through the restricted diameter in the flow path;

FIG. 2 is a diagrammatic illustration, shown in section, depicting an indexing device, illustrated particularly in the form of a rotary motor operated ball-spring type indexing valve having a ball actuating cam;

Figure 2:
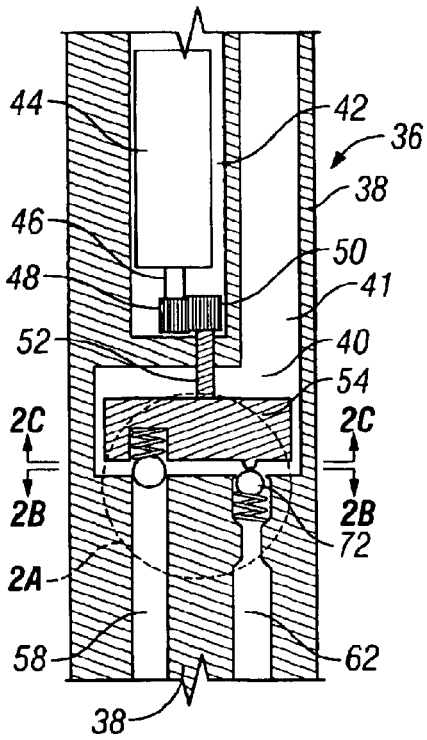
Figure 2A:
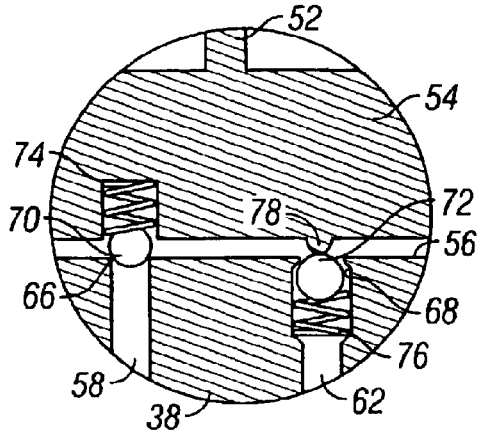
Figure 2B:
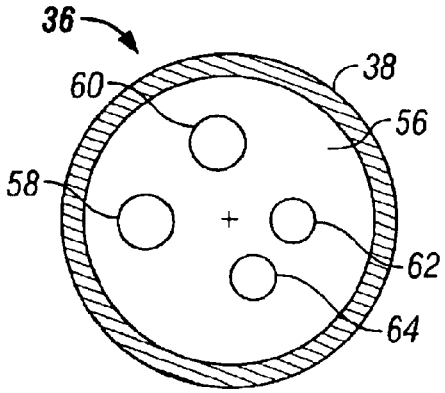
Figure 2C:
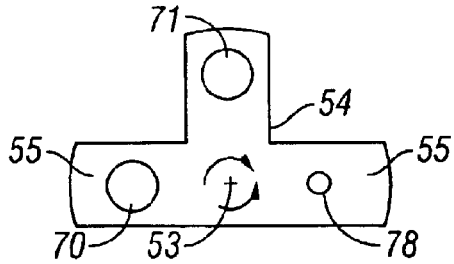
Figure 3:
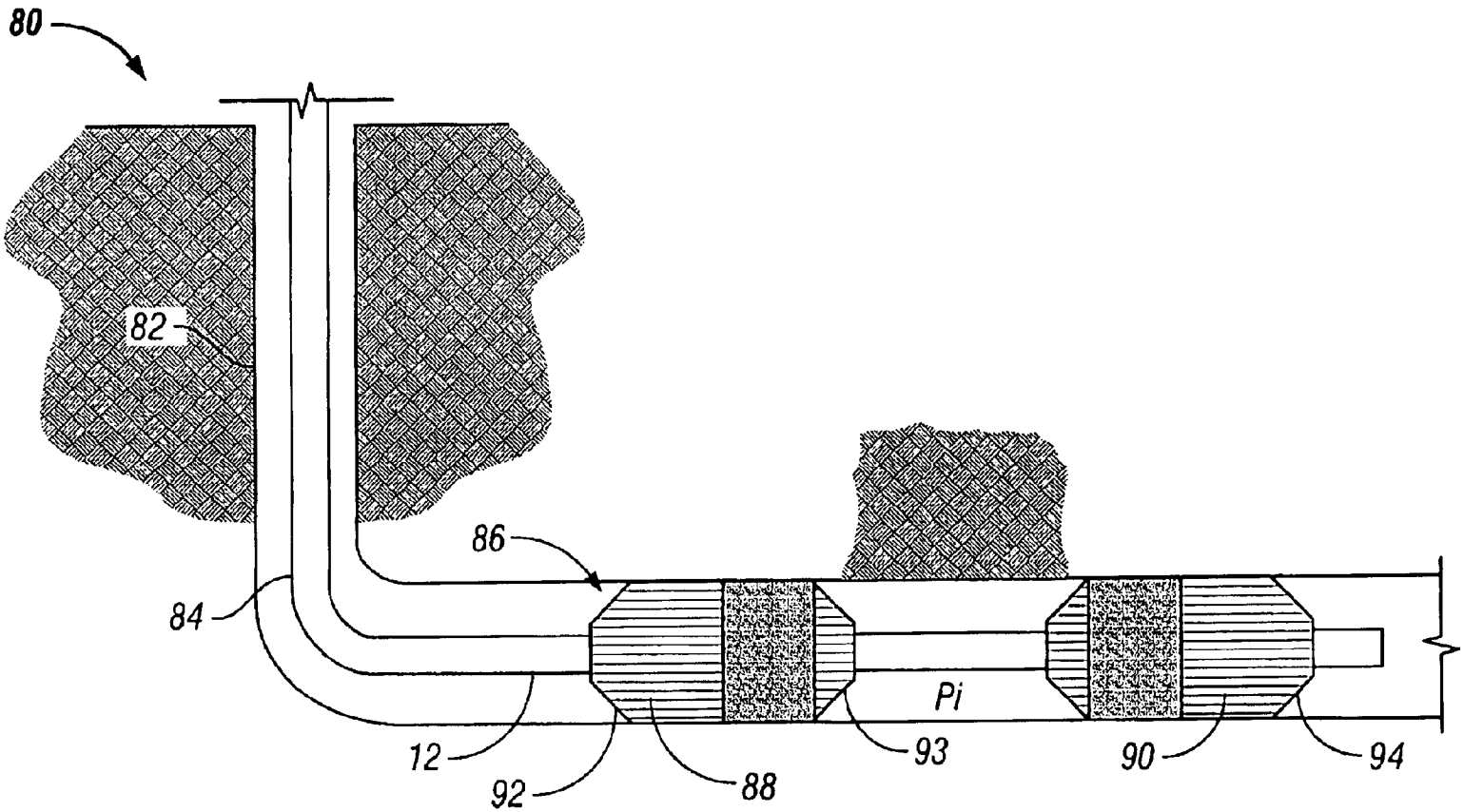
Figure 4:
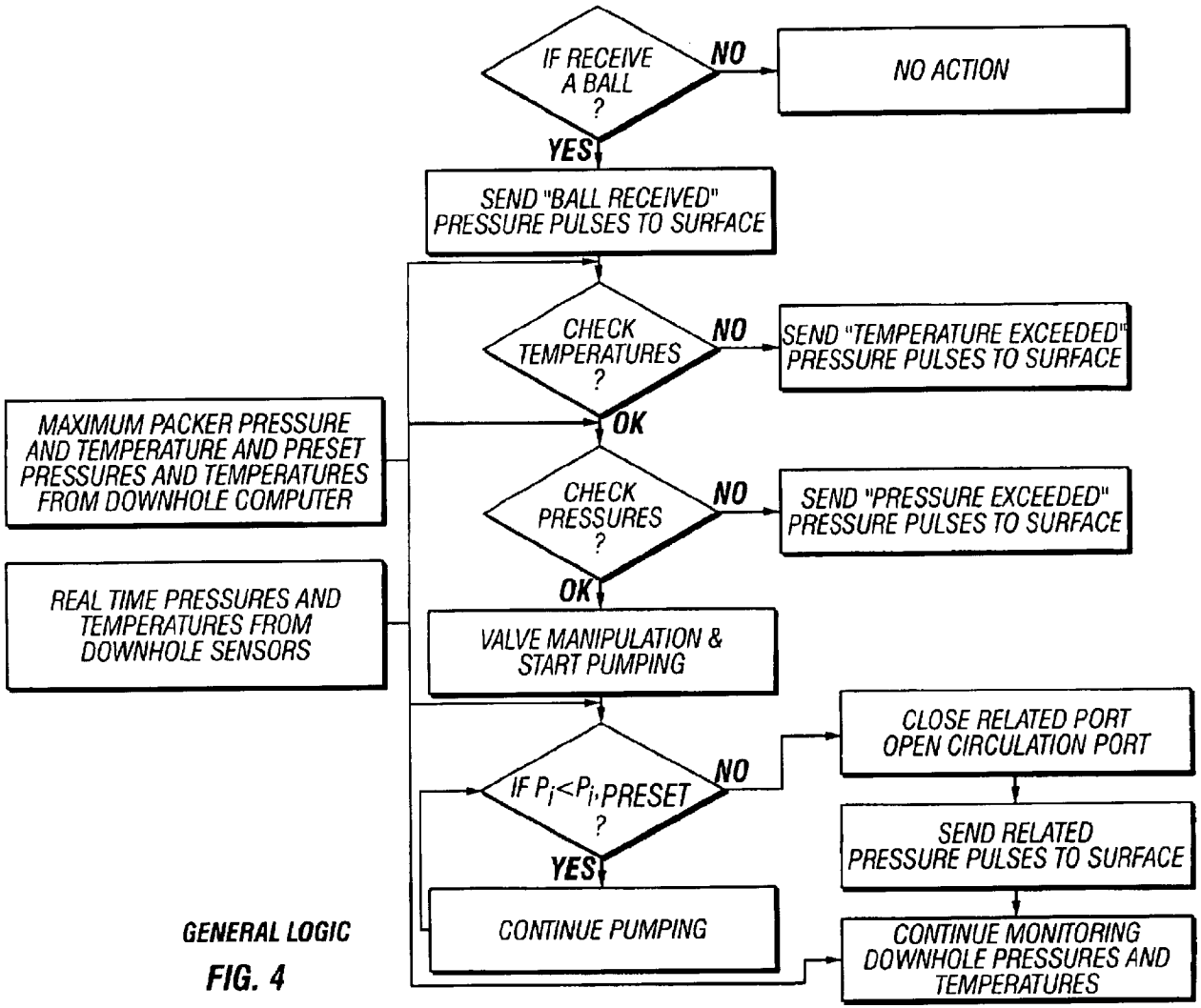
Figure 5:
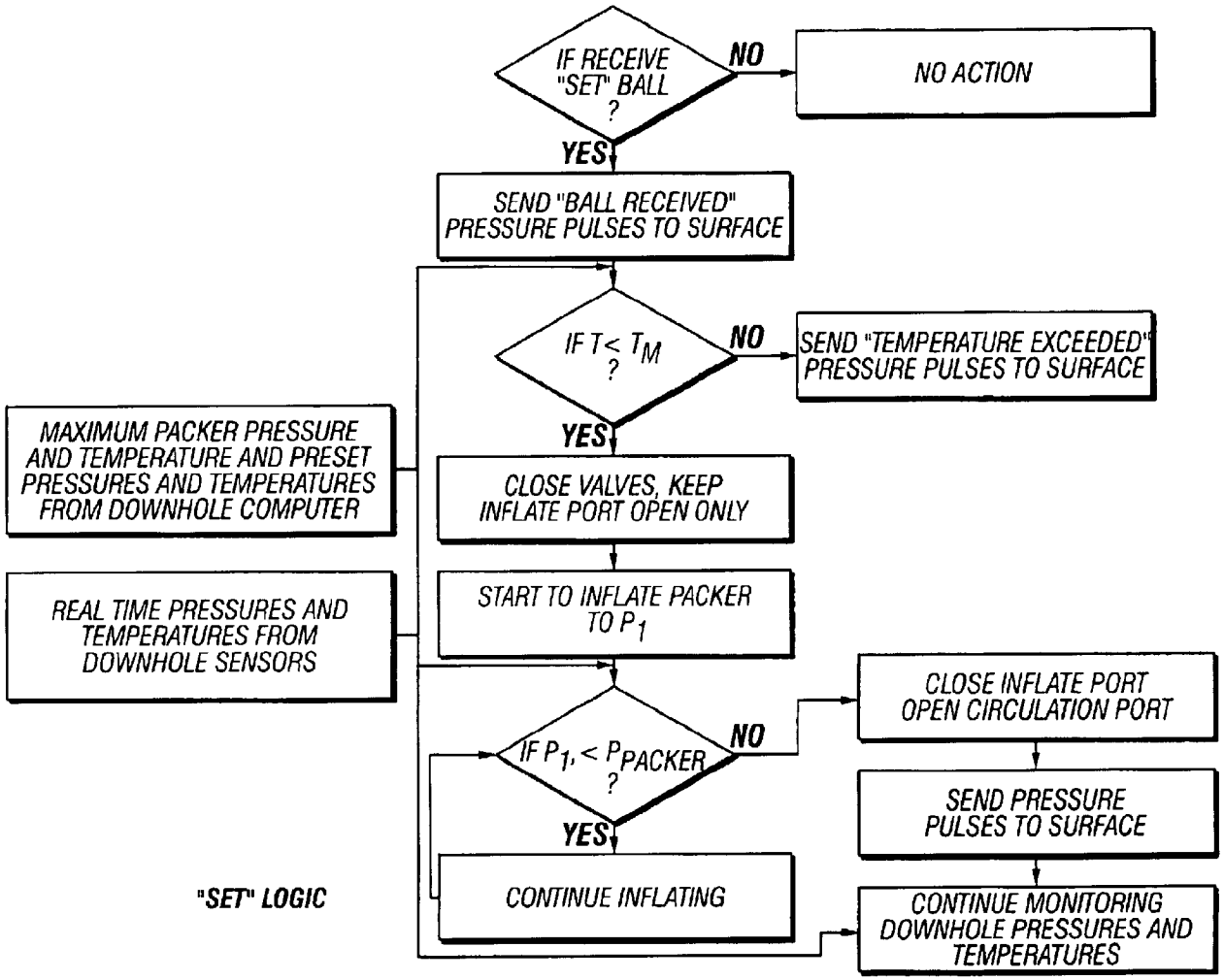
Figure 6A:
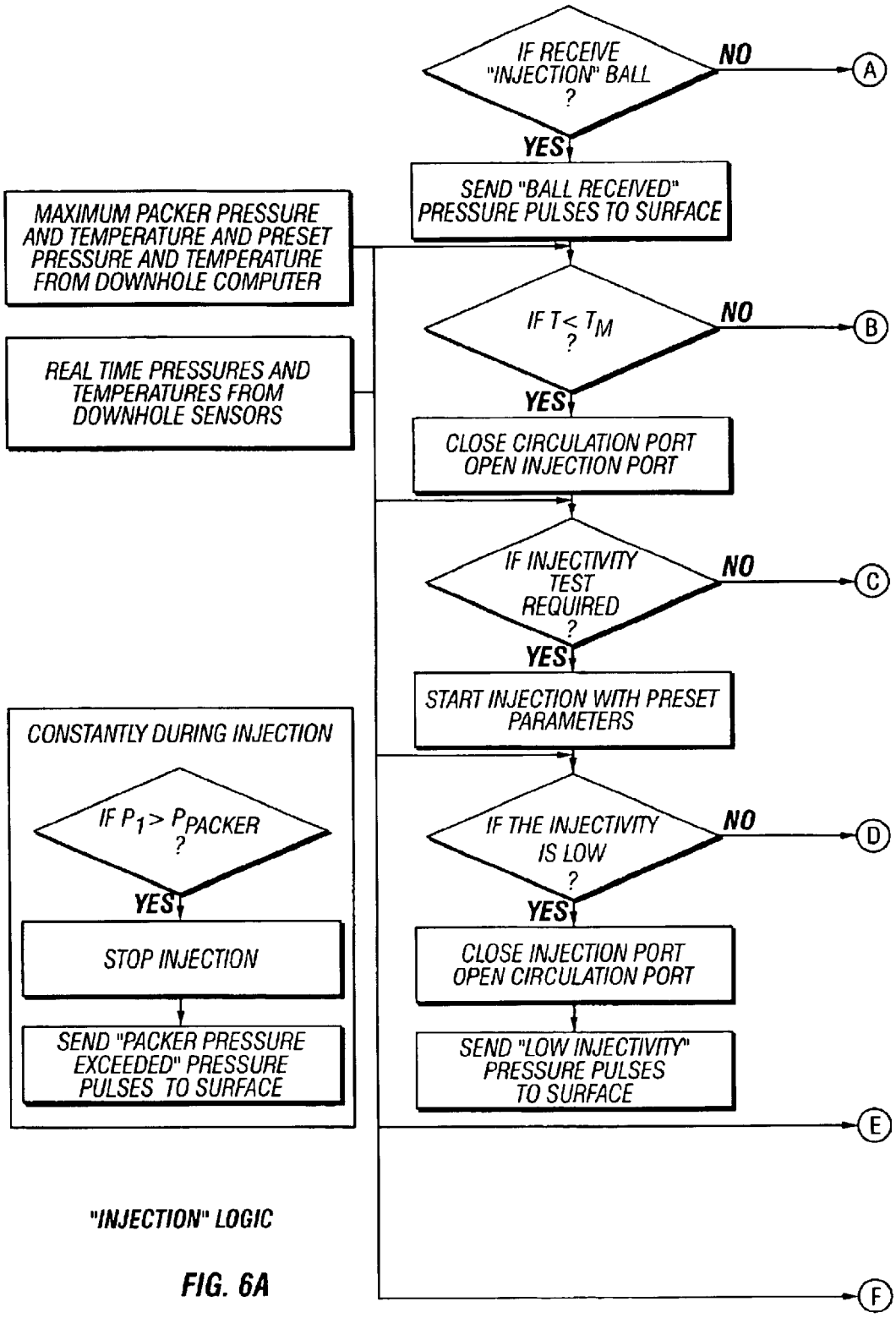
Figure 6B:
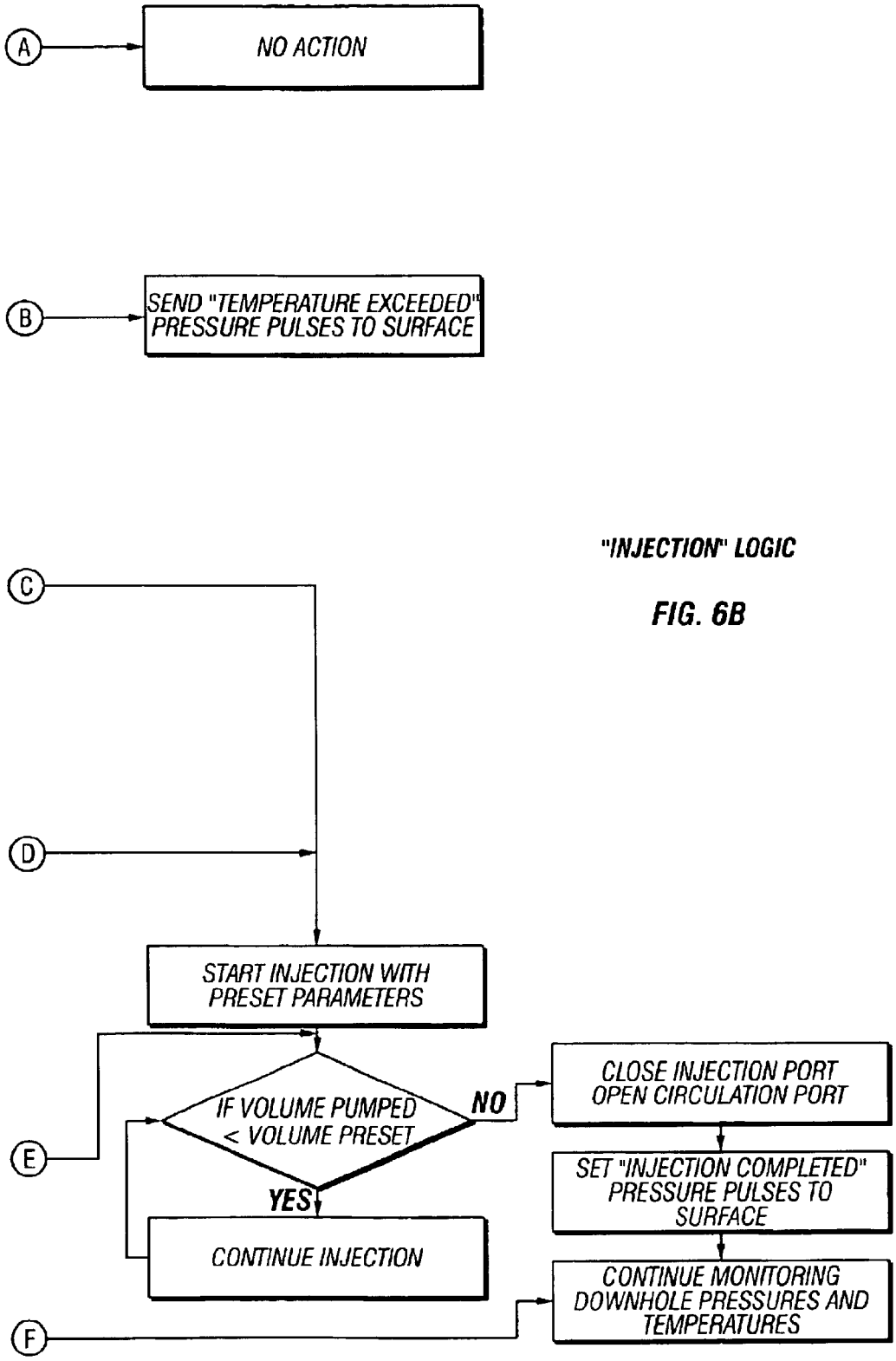
Figure 7:
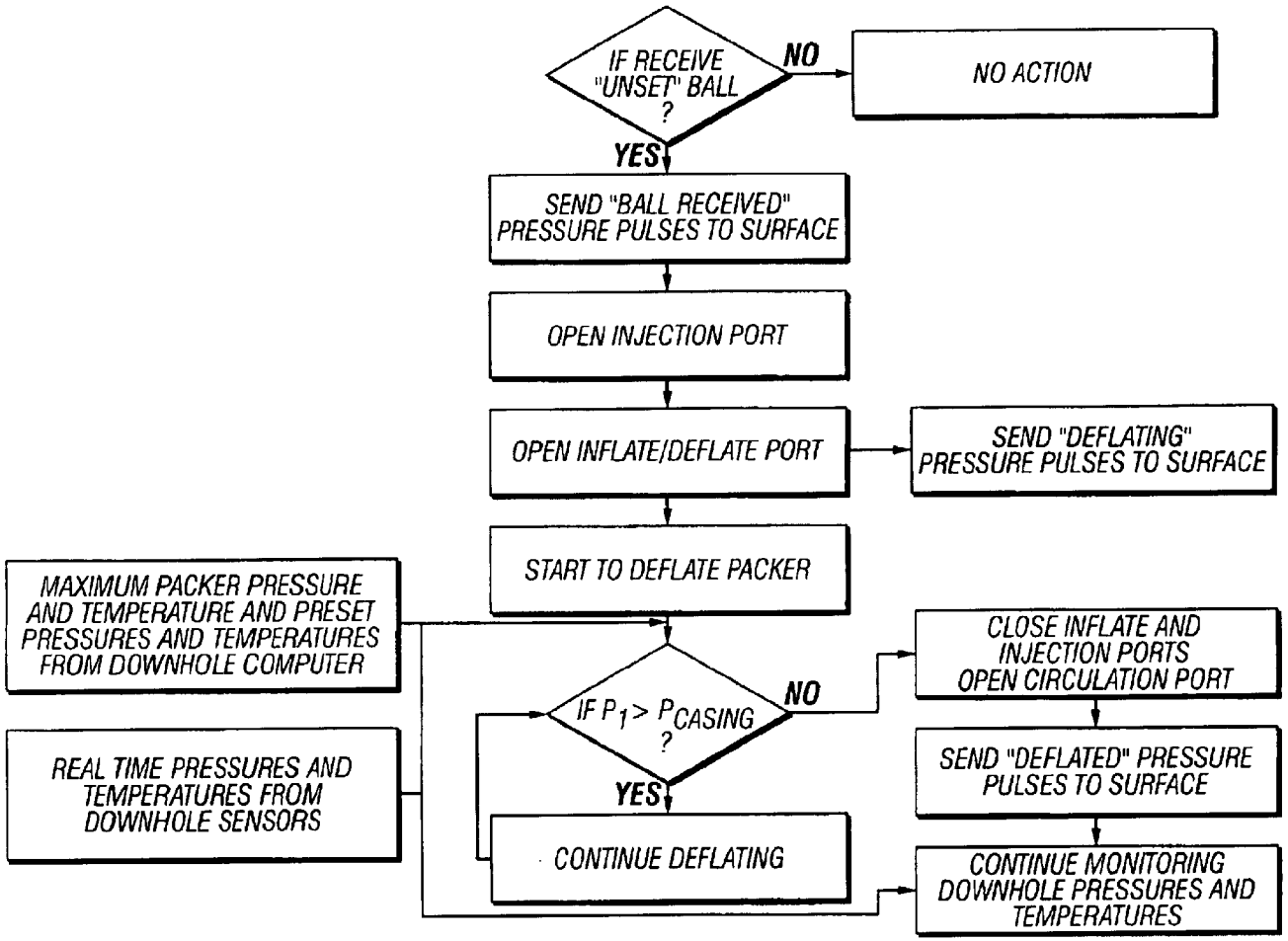
Figure 8:
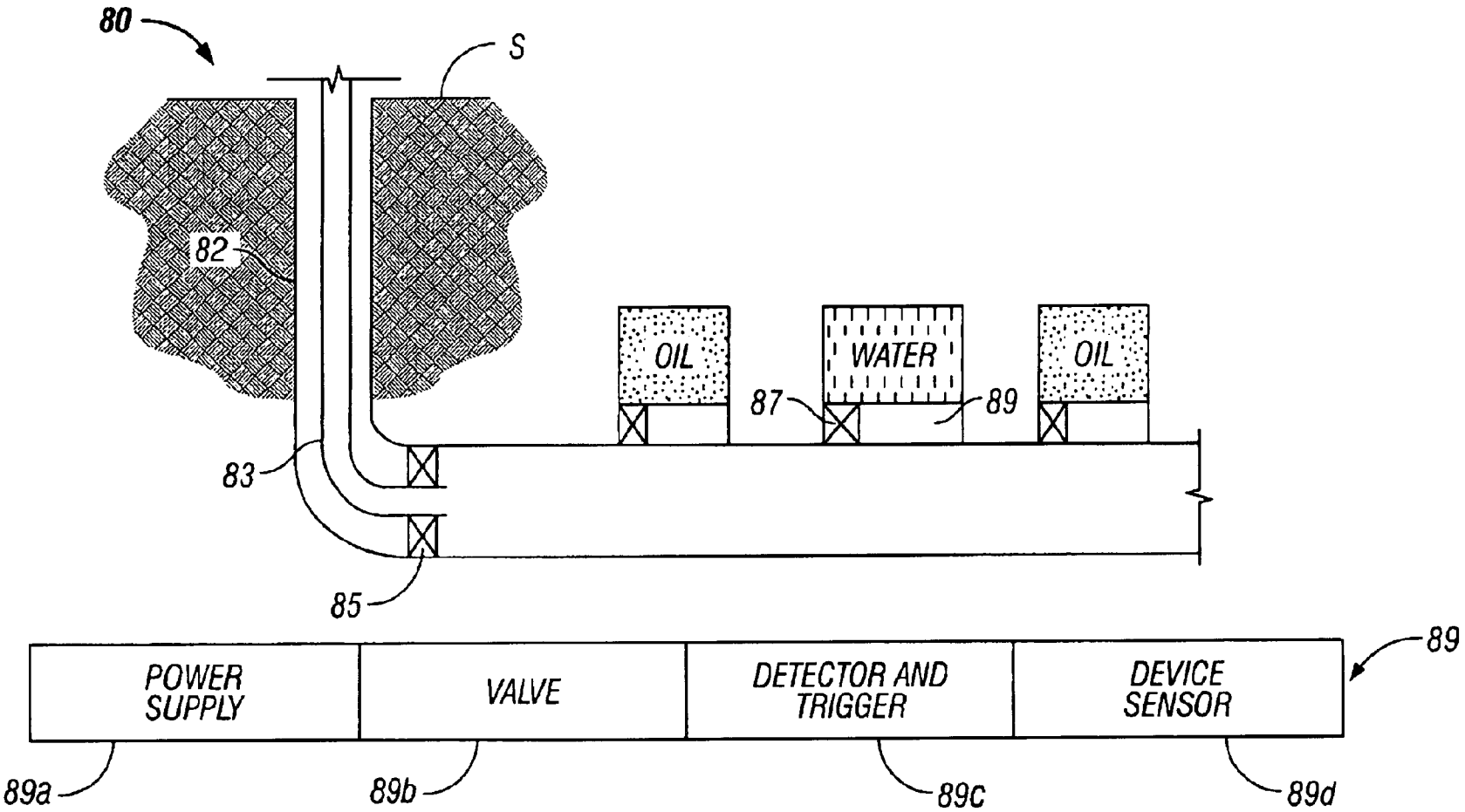
Figure 9:
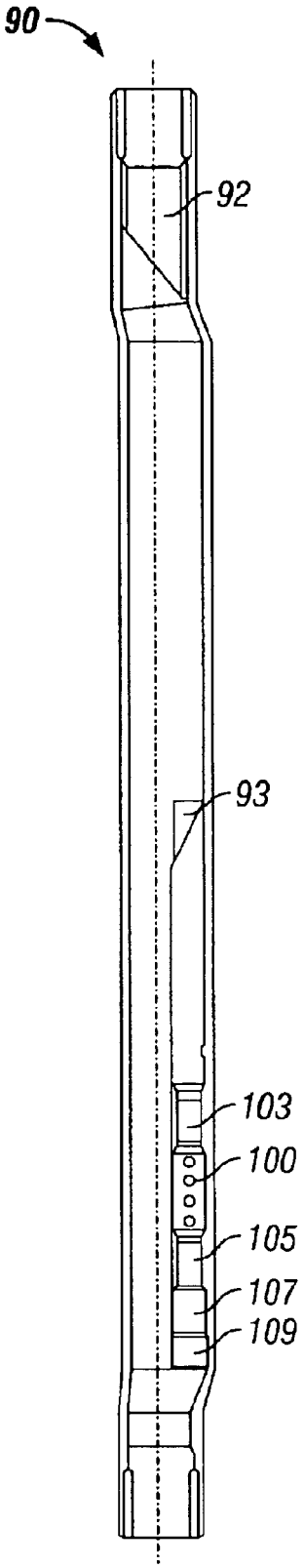
Figure 10:
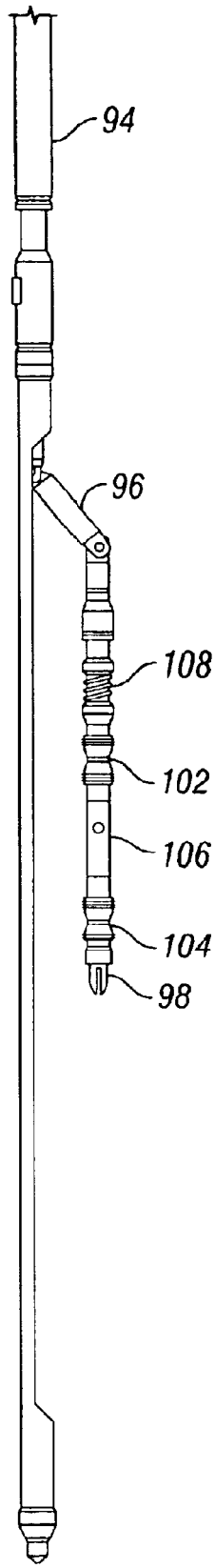

FIG. 2A is an enlarged view of the indexer and spring-urged valve mechanism of FIG. 2, showing the construction thereof in detail;

FIG. 2B is a sectional view taken along line 2B—2B of FIG. 2 showing the outlet arrangement of the motorized, spring-urged valve mechanism of FIG. 2;

FIG. 2C is a bottom view of the indexer of FIG. 2, taken along line 2C—2C, showing the arrangement of the spring-urged ball type check valve elements thereof;

FIG. 3 is a schematic illustration of a well system with a straddle packer mechanism therein which has inflate/deflate, circulate and inject modes and has the capability for acquisition and computer processing of bottom-hole, packer, injection and formation pressures and temperatures, to transmit this acquired data uphole to the surface or achieve well control functions with or without sending signals uphole;

FIG. 4 is a logic diagram illustrating the general logic of a straddle packer control system embodying the principles of the present invention;

FIG. 5 is a logic diagram illustrating the "set" logic of a straddle packer tool embodying the principles of the present invention;

FIGS. 6A and 6B are a logic diagram illustrating the "injection" logic of a straddle packer tool embodying the principles of the present invention;

FIG. 7 is a logic diagram illustrating the "unset" logic of a straddle packer tool embodying the principles of the present invention;

FIG. 8 is a schematic illustration of a well system producing from a plurality of zones with production from each zone controlled by a valve and illustrating the need for valve closure at one of the production zones due to the detection of water and the use of the principles of the present invention for accomplishing closure of a selected valve of the well production system; and FIGS. 9–14 are longitudinal sectional views illustrating the use of a side pocket mandrel in a production string of a well and a kick-over tool for positioning a battery within or retrieving a battery from a battery pocket of the side pocket mandrel, thus illustrating battery interchangeability for electrically energized well control systems using the technology of the present invention.

DETAILED DESCRIPTION OF THE INVENTION

From the standpoint of explanation of the details and scope of the present invention data telemetry systems are discussed in connection with terms such as data transmission "balls", "drop balls", "darts", "objects", "elements", "devices", and "fluid". It is to be understood that these terms identify objects or elements that are conveyed from the surface through well tubing to a downhole tool or apparatus having the capability to "read" data programmed in or carried by the objects or elements and to carry out instructions defined by the data. The objects or elements also have the capability of transmitting one or more instructions depending upon characteristics that are present in the downhole tool or apparatus or the downhole environment within which the downhole tool or apparatus resides. It should also be understood that the term "fluid" is intended to be encompassed within the term "element" for purposes of providing an understanding of the spirit and scope of the present invention. Additionally, for purposes of the present invention, the term "drop" is intended to mean an object that is caused to descend through well tubing from the surface to downhole apparatus by any suitable means, such as by gravity descent, by transporting the object in a fluid stream, and by also returning the object to the surface if appropriate to the telemetry involved.

Internal Telemetry

An internal telemetry system for data telemetry in a well consists of at least two basic components. First, there must be provided a conveyance device that is used to carry information from the surface to the tool. This conveyance device may be a specially shaped object that is pumped through the coil of a coiled tubing, or may comprise a fluid of predetermined character representing an identification or instruction or both. The fluid is detected as it flows through a wire coil or other detector. The second required component for internal telemetry is a device in the downhole tool that is capable of receiving and interpreting the information that is transported from the surface by the conveyance device.

According to the present invention, data conveyance elements may be described as "tagged drop balls" generally meaning that telemetry elements that have identity and instruction tags of a number of acceptable forms are dropped into or moved into well tubing at the surface and are allowed to or caused to descend through the conveyance passage of the well tubing to a downhole tool or other apparatus where their identity is confirmed and their instructions are detected and processed to yield instruction signals that are used to carry out designated downhole tool operations.

The identification and instructions of the telemetry elements may take any of a number of other forms that are practical for internal well telemetry as explained in this specification. The telemetry element may also take the form of a fluid having a particular detectable physical or chemical characteristic or characteristics that represent instructions for desired downhole activities. Thus, the discussion of telemetry elements in the form of balls is intended as merely illustrative of one embodiment of the present invention. However, telemetry elements in the form of balls are presently considered preferable, especially when coiled tubing is utilized, for the reason that small balls can be easily transported through the typically small flow passage of the coiled tubing and can be readily conveyed through deviated or horizontal wellbores or multilateral branches to various downhole tools and equipment that have communication with the tubing.

Figure 1:
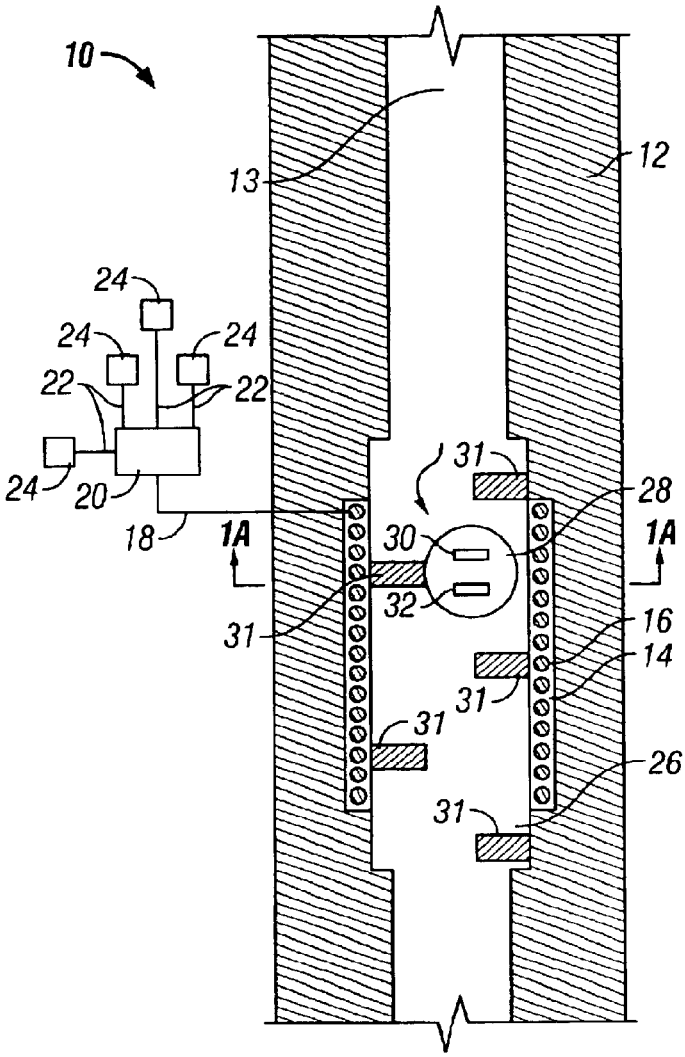
Figure 1A:
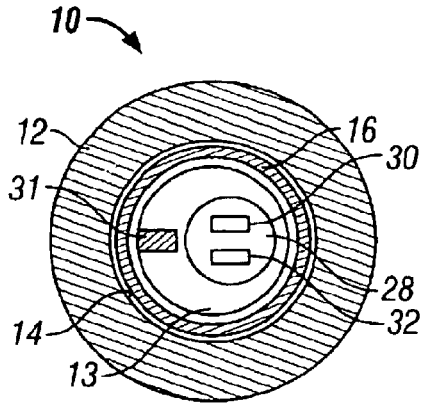

Referring now to the drawings and first to FIGS. 1 and 1A, there is shown an internal telemetry universal fluid control system, generally at 10, having a tool chassis 12 defining an internal flow passage 13 that is in communication with the flow passage of well tubing. The present invention has particular application to coiled tubing, though it is not restricted solely to use in connection with coiled tubing. Thus, the tool chassis 12 is adapted for connection with coiled tubing or other well tubing as desired. The tool chassis 12 defines an internal receptacle 14 having a detector 16 located therein that, as shown in FIGS. 1 and 1A, may take the form of a radio frequency (RF) antenna. The detector 16 may have any number of different characteristics and signal detection and response, depending on the character of the signal being conveyed. For example, the detector 16 may be a magnetic signal detector having the capability to detect telemetry elements having one or more magnetic tags representing identification codes and instruction codes. Various other detector forms will be discussed in greater detail below. The detector 16, shown as an RF antenna in FIG. 1, is shown schematically to have its input/output conductor 18 coupled with an electronic or mechanical processor circuit 20 that receives and processes identification recognition information received from the RF antenna or other detector 16 and also receives and processes instruction information that is received by the antenna. One or more activity conductors 22 are provided for communication with the processor circuit 20 and also communicate with one or more actuator elements 24 that accomplish specifically designated downhole functions.

The tool chassis 12 defines a detection chamber 26 within which the internal receptacle 14 and detector 16 are located. The detection chamber 26 is in communication with and forms a part of the flow passage 13 thus permitting the flow of fluid through the flow passage 13 of the chassis 12 and permitting movement of telemetry objects or elements through the tool chassis 12 as required for carrying out internal telemetry for accomplishing downhole activities in the well system.

Figure 1C:
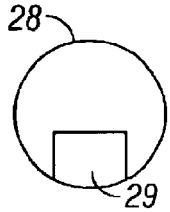
Figure 1B:
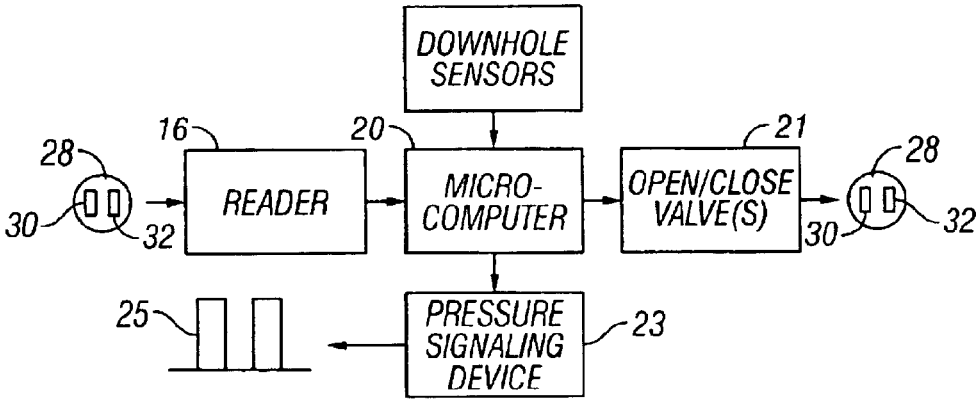

According to the principles of the present invention, and as shown in the logic diagram of FIG. 1B, internal telemetry is conducted within wells by moving telemetry elements 28, also referred to as data conveyance objects, from the surface through the tubing and through the tool chassis 12 in such manner that the identity information (ID) of the telemetry element and its instruction information may be detected, verified and processed by the detector or reader 16 and electronic or mechanical processor circuit 20. In FIGS. 1, 1A and 1B the telemetry element 28 is shown as a small sphere or ball, but it is to be borne in mind that the telemetry elements 28 may have any of a number of geometric configurations without departing from the spirit and scope of the present invention. Each telemetry element, i.e., ball, 28 is provided with an identification 30 and with one or more instructions 32. The identification and instructions may be in the form of RF tags that are embedded within the telemetry element 28 or the identification and instruction tags or codes may have any of a number of different forms within the spirit and scope of the present invention. The telemetry elements 28 may have "read only" capability or may have "read/write" capability for communication with downhole equipment or for acquisition of downhole well data before being returned to the surface where the acquired data may be recovered for data processing by surface equipment. For example, the read/write capable telemetry element or ball 28 may be used as a permanent plug to periodically retrieve downhole well data such as pressure and temperature or to otherwise monitor well integrity and to predict the plug's life or to perform some remedy if necessary. If in the form of a ball or other small object, the telemetry element 28 may be dropped or pumped downhole and may be pumped uphole to the surface if downloading of its data is deemed important. In one form, to be discussed below, the telemetry element 28 may have the form of a side pocket tool that is positioned within the pocket of a side pocket mandrel. Such a tool may be run and retrieved by wireline or by any other suitable means.

As shown in FIG. 1C, a telemetry element 28, which is shown in the form of a ball, but which may have other desirable forms, in addition to the attributes discussed above in connection with FIGS. 1, 1A, and 1B, may also include a ballast 29 which is releasable from the ball in the downhole environment. For example, the ballast 29 may be secured by a cement material that dissolves in the conveyance fluid after a predetermined period of exposure or melts after a time due to the temperature at the depth of the downhole tool. When the ballast 29 is released, the specific gravity of the telemetry ball 28 changes and permits the ball to ascend thorough the conveyance fluid to the surface for recovery. The ball 28, with or without the ballast, may be pumped through the conveyance passage to the surface if desired.

It may not be necessary to cause the flow of wellbore fluid to the surface for testing, which has some limitations or regulations, if a read/write telemetry element or ball is employed. All of the well condition measurements/analyses may be performed downhole, and the test results may be retrieved by pumping the read/write ball 28 to the surface for downloading the test data therefrom.

Especially when coiled tubing is utilized for fluid control operations in wells, the fluid typically flowing through the coiled tubing will tend to be quite turbulent and will tend to have high velocity. Thus, it may be appropriate for the velocity of movement of a telemetry element to be slowed or temporarily rendered static when it is in the immediate vicinity of the antenna or other detector. One method for slowing the velocity and rotation of the tagged drop ball telemetry element 28 within the detection chamber 26 of the tool chassis 12 is shown in FIG. 1. Internal protrusions 31, shown in FIGS. 1 and 1A, serve to change the direction of motion of the drop ball 28 from purely axial movement to a combination of axial and radial movement, thus delaying or slowing transit of the drop ball 28 through the detection chamber 26 of the tool chassis 12. These repeated changes in direction result in a reduced overall velocity, which permits the telemetry element 28 to remain in reading proximity with the detector or antenna 16 for a sufficient period of time for the tag or tags to be accurately read as the telemetry element 28 passes through the detection chamber 26. Furthermore, FIG. 1A shows that a substantial fluid flow area remains around the drop ball 28. This feature helps prevent an excessive pressure drop across the ball that would tend to increase the drop ball velocity through the antenna of the detection chamber 26. The protrusions 31 may be of rigid or flexible character, their presence being for altering the path of movement of the drop ball 28 through the detection chamber 26 and thus delay the transit of the ball through the detection chamber sufficiently for the embedded data of the ball to be sensed and the data verified and processed. The protrusions may be designed to "catch" the telemetry element at a predetermined range of fluid flow velocity and restrain its movement within the detection chamber, while the fluid is permitted to flow around the telemetry element. At a higher fluid flow velocity, especially if the internal protrusions are of flexible nature, the telemetry element can be released from the grasp of the protrusions and continue movement along with the fluid flowing through the tubing.

Referring now specifically to the logic diagram of FIG. 1B, a telemetry element 28 which is shown in the form of a ball, has embedded identification and instruction tags 30 and 32 and is shown being moved into a reader 16, which may be an RF antenna, to yield an output signal which is fed to a microcomputer 20. It should be noted that the identification and instruction tags 30 and 32 may comprise a read-only tag with only an identification number, or a read/write tag containing a unique identification number and an instruction set. Downhole condition signals, such as pressure and temperature, from downhole sensors are also fed to the microcomputer 20 for processing along with the instruction signals from the reader 16. After signal processing, the microcomputer 20 provides output signals in the form of instructions that are fed to an apparatus, such as a valve and valve actuator assembly 21, for opening or closing a valve according to the output instructions. When movement of the mechanical device, i.e., valve, has been completed, the microcomputer 20 may also provide an output signal to a pressure signaling device 23 which develops fluid pulse telemetry 25 to the surface to thus enable confirmation of successful completion of the instructed activity. After the instructed activity has been completed, the telemetry element 28, typically of small dimension and expendable, may simply be released into the wellbore. If desired, the telemetry element 28 may be destroyed within the well and reduced to "well debris" for ultimate disposal. However, if the telemetry element 28 has read/write capability, it may be returned to the surface with well data recorded and may be further processed for downloading the well data to a surface computer.

In addition to the apparatus illustrated in FIG. 1, one or more of several other devices may be used to orient and/or slow the linear or rotational velocity of the telemetry element 28. These devices are illustrated in FIGS. 1D–1H.

Figure 1D:
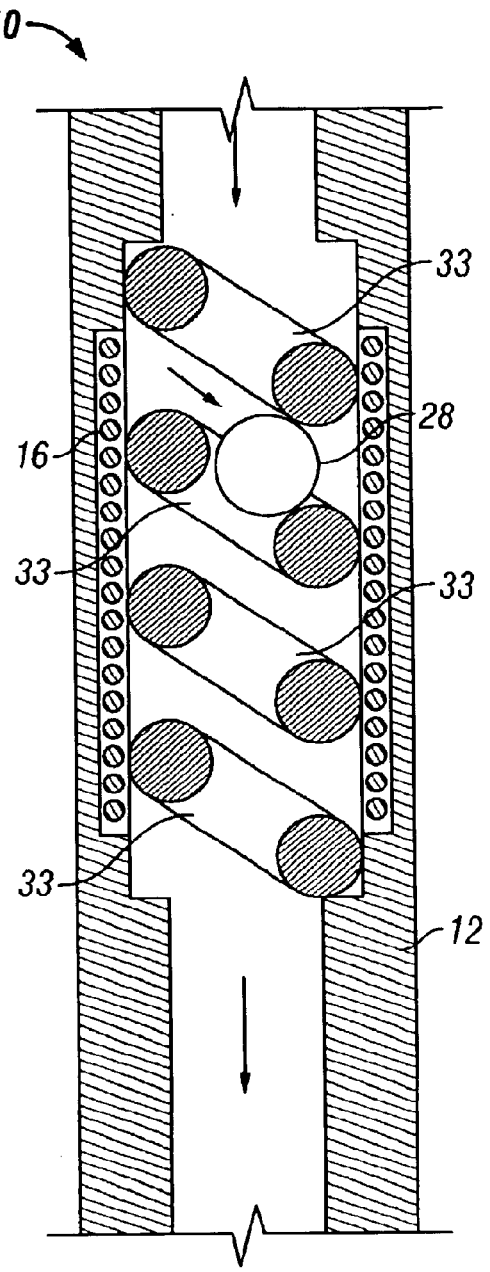

FIG. 1D illustrates a mechanism to force the telemetry element or tagged object 28 to follow a helical, rather than linear, path through a section of the tool chassis 12. The pitch and diameter of the helix elements 33 may be sized to adjust the amount of time required for the ball 28 to travel through the helical mechanism. This in turn gives the reader 16 in the tool sufficient time to read the tagged object 28.

Figure 1E:
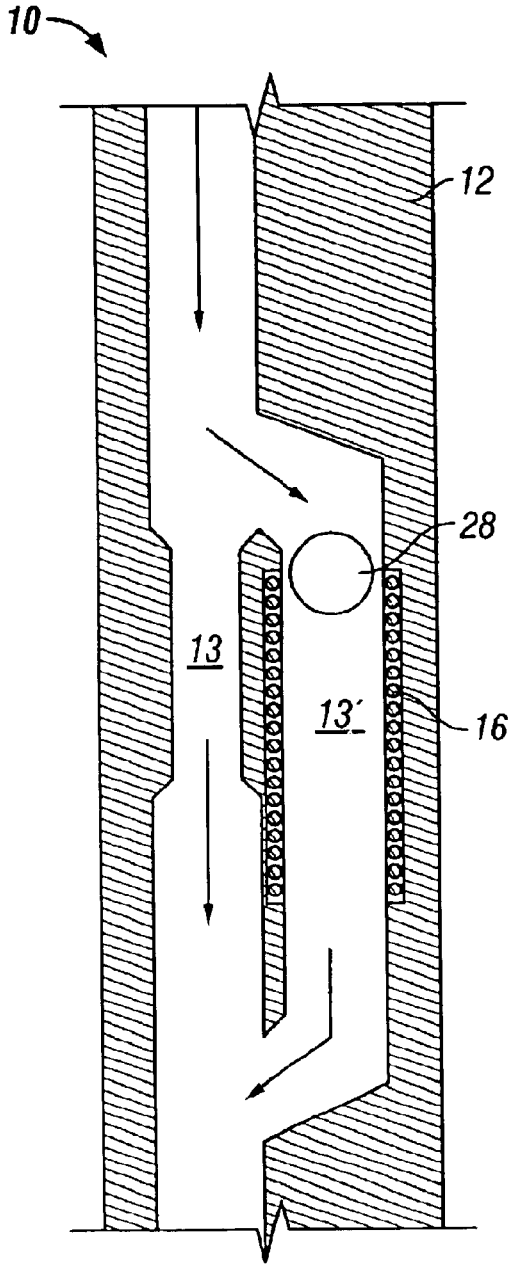

FIG. 1E illustrates a mechanism to divert the tagged object 28 out of the main flow path 13 into a secondary flow path 13'. The secondary flow path 13' branches off the main flow path 13, runs in parallel with the main flow path 13 for a certain distance, and then feeds back into the main flow path 13. Because the fluid has a larger effective area to flow through, the average fluid velocity will decrease in the secondary flow path 13 where the tagged object 28 will be identified by the detector 16.

Figure 1F:
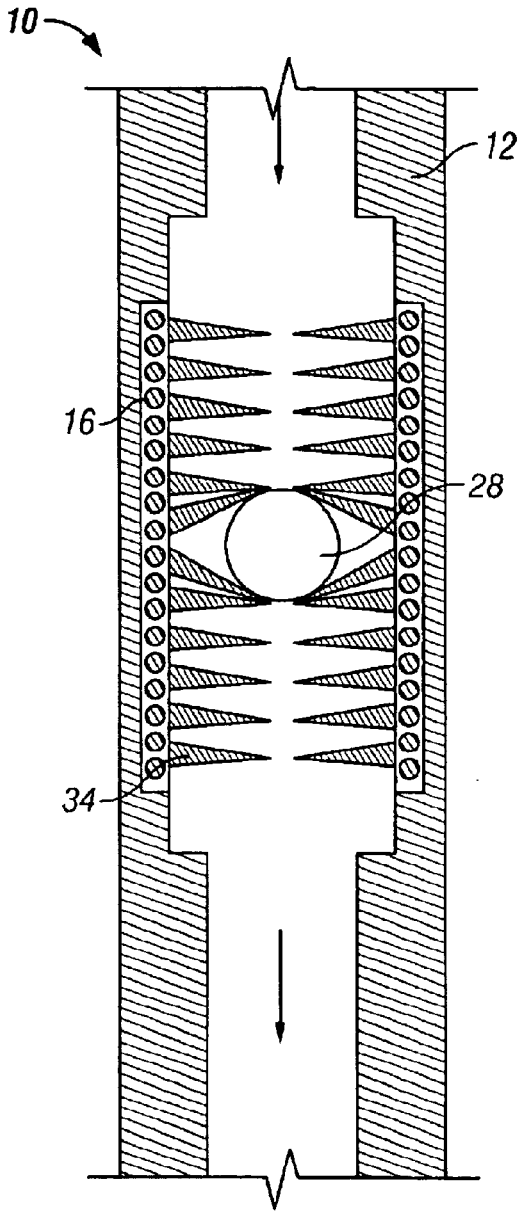

FIG. 1F illustrates a system 10 that creates a frictional force against an object of a certain size that is passed through the tool. For instance, small elastic "fingers" 34 protrude into the flow path in the vicinity of the reader 16. As the tagged object 28 moves through the reader 16, its velocity is reduced as it forces its way past the elastic fingers 34. The elastic fingers 34 may be metallic, nonmetallic, or both, and may be arranged in a variety of configurations.

Figure 1G:
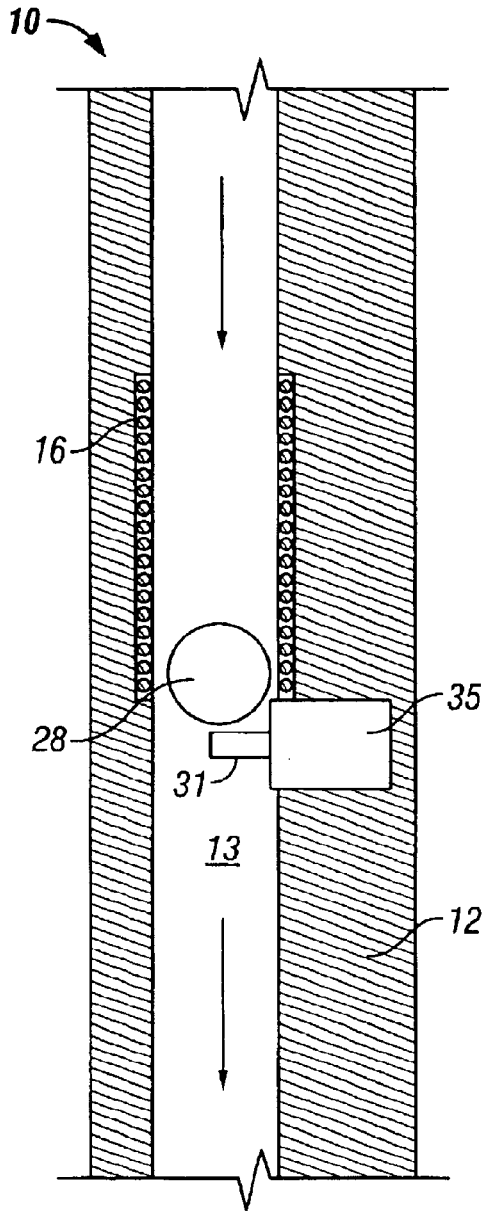

FIG. 1G illustrates a tool with a protrusion 31 in the flow path 13 that is controlled by the tool. For instance, a solenoid 35 is positioned so that, in its de-energized position, the protrusion 31 obstructes the flow just below the reader antenna 16. While fluid can still flow around the protrusion 31, the tagged object 28 is prevented from doing so. Once the tool identifies a tagged object 28 that has been stopped by the protrusion 31, the solenoid 35 is energized and the protrusion 31 is moved out of the flow path 13. The tagged object 28 is once again able to move freely.

Figure 1H:
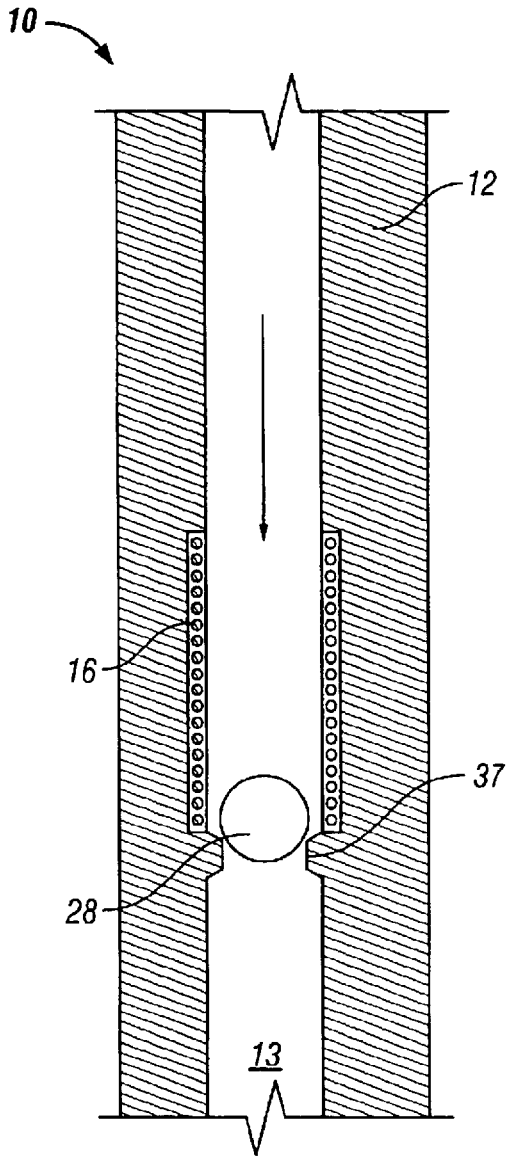
Figure 1I:
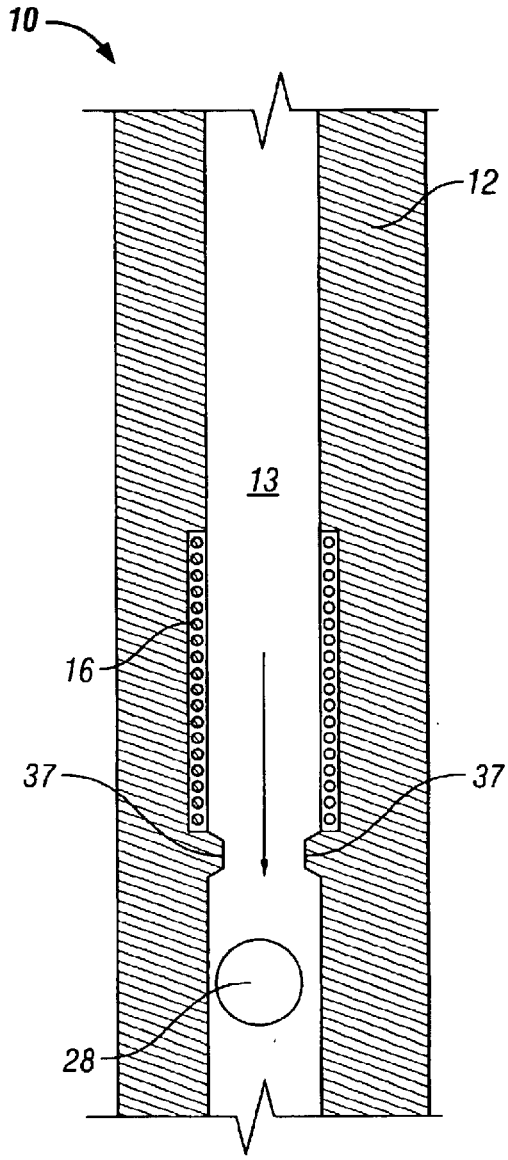

FIG. 1H illustrates a tool with a restricted diameter 37 in the flow path 13 that is slightly smaller than the diameter of the tagged object (e.g. drop ball) 28. When the tagged object 28 reaches the section 37 with the reduced diameter, it stops and "plugs" the hole. This causes a large pressure differential across the tagged object 28, which is sufficient to force the tagged object 28 through the restricted diameter 37 as illustrated in FIG. 1I. The reading device 16 is positioned to read the tagged object 28 as soon as it is stopped by the restricted diameter 37. Note that some of the flow may be diverted around the restricted diameter 37 so as not to completely block the flow path.

The above devices, including that of FIG. 1, may be used alone or in conjunction with one another. For example, the devices of FIGS. 1E and 1F may be combined so that elastic fingers 34 are included in the secondary flow path 13'.

If data conveyance elements, such as drop balls, are caused to move from the surface through well tubing to a downhole tool by gravity descent, by flowing fluid, or by any other means, the challenge arises as to what to do with the objects once they have been identified by the tool. If the data conveyance elements are small and environmentally friendly, they may simply be released into the well. If this is not acceptable, the data conveyance elements may be collected by the tool and later disposed of at the surface when the well tool is retrieved from the well. Another alternative is to use data conveyance balls that either disintegrate or can be crushed after they are used. Certain types of activating balls are available that are designed for self-destruction when well fluid pressure increases above a certain level. That way, once they are used, they can be intentionally destroyed and reduced to a more manageable or inconsequential size. This same technology may be applied to the internal telemetry conveyance objects to overcome disposal or storage constraints.

For a telemetry element to carry information from the surface to a downhole tool, it must have an intelligence capability that is recognizable by a detector of a downhole tool or equipment. Each data conveyance element must, in its simplest form, possess some unique characteristic that can be identified by the tool and cause the tool to accomplish a designated function or operation. Even this basic functionality would allow an operator to send a data conveyance element having at least one distinguishing characteristic (e.g. identification number) corresponding to a preprogrammed response from the downhole tool. For example, upon receiving a data conveyance element having an identification and having pressure or temperature instructions or both, the tool's data microprocessor, after having confirmed the identity of the data conveyance element, would, in response to its instructions, take a pressure or temperature measurement and record its value. Alternatively, the intelligence capability of the telemetry element may be in the form of instruction data that is recognized by a detector of the downhole tool and evokes a predetermined response.

Various types of data conveyance mechanisms and telemetry elements may be employed within the spirit and scope of the present invention as discussed below. It is to be borne in mind that the present invention is not restricted to the group of data conveyance mechanisms that are discussed below, these being provided only as representative examples.

Fluids

One form of internal telemetry that does not actually require a conveyance object, such as a drop ball, may take the form of one or more specific fluids, properties of which are detected by the detector of a tool and rendered to electronic form for processing. For example, when it is desired to send the tool either information or instructions, an operator may simply pump a particular fluid down the well tubing to a detector coil. Such fluids may include, for example, acids, brine, or diesel fuel. A sensor in the tool is designed to detect the pH (acids), conductivity (brine), or density (diesel fuel) of the fluid, or a trace element or chemical in the fluid. When the fluid reaches the tool, the property, trace element, or chemical is detected and the detector communicates to the tool that a predetermined action must now take place. The microcomputer of the tool then provides one or more signal outputs to accomplish mechanical functions responsive to the instructions that are detected.

In addition to detecting a fluid property, trace element, or chemical in the fluid, a sensor in the tool may also be designed to detect the presence of a physical additive that does not affect the usage or performance of the fluid. For example, the additive may take the form of tiny metallic elements that reflect electromagnetic waves in a detectable way. Because the metallic elements do not react chemically with the fluid, the properties of the fluid are not substantially altered. When the tool detects the presence of the additive in the fluid, a preprogrammed response is initiated. The fluid is then used in its standard way to perform the job, unaffected by the presence of the additives.

Radioactive Materials

Radioactive markers are at times used downhole to identify specific locations in a well. For example, a tool string may be equipped with the proper detection equipment to identify the instruction marker as the tool passes the radioactive marker. For example, a radioactive tag might be placed above a multilateral entry (a branch bore opening from a primary wellbore) to facilitate both finding and entering the multilateral branch. In a similar way, a detection device may be configured to recognize specific radioactivity on the inside of the tool. A radioactive tag, ball, or other device may then be dropped from surface and identified by the detector of the tool, thereafter eliciting some prescribed response from the tool. The obvious health and environmental issues associated with the use of radioactive materials in wells must be considered in implementing this method, but it is nonetheless a possible form of telemetry.

Magnetic Materials

Magnetic materials may be used in several ways to convey information from the surface to a downhole tool. For example, a drop ball may be embedded with a magnetic material that disrupts the field of a corresponding magnetic sensor in the downhole tool in a predictable way. This enables the operator to communicate with the downhole tool by sending balls with magnetic properties that will be correctly interpreted by the tool.

As another example, consider the magnetic stripe on an ordinary credit card. Information is stored in the stripe and retrieved when the card is passed through a reader. Similarly, a drop ball may contain magnetic storage media that is accessible by a reading device in the tool.

Micro-Electro-Mechanical Systems (MEMS)

MEMS embody the integration of mechanical elements, sensors, actuators, and electronics on a common silicon substrate. Using MEMS, a drop ball may be designed to emit a detectable signal for a downhole reader based on a number of physical phenomena, including thermal, biological, chemical, optical, and magnetic effects. Likewise, the downhole reader may itself be equipped with MEMS to detect information conveyed from surface, such as through chemicals or magnetic materials. For example, trinitrotoluene (TNT) can be detected by MEMS coated with platinum (developed by Oak Ridge National Laboratory, Tenn., USA). The TNT is attracted to the platinum, resulting in a mini-explosion that deflects a tiny cantilever, the cantilever deflection resulting in an electrical response. Furthermore, other MEMS contain bacteria on the chip that emit light in the presence of certain chemicals, such as soil pollutants. This light can be detected and used to initiate a corresponding action (developed by Oak Ridge National Laboratory and Perkin Elmer, Inc. of Wellesley, Mass., USA).

In the same way, chemicals common to oilfield applications may be detected by MEMS that are appropriately designed. For instance, multiple types of MEMS used in the same reader enable the tool to make job-related decisions based on different fluids, even without the use of a microprocessor or complicated circuitry. MEMS are currently being developed that combine digital and analog circuitry on the same substrate. This circuitry enables the MEMS to analyze one or more inputs, identify a chemical, biological or similar "trigger", and control one or more outputs accordingly. With this capability, for example, a downhole tool can shift to an "acid treating" position when the MEMS detect the presence of chlorine in hydrochloric acid that is pumped through the tool. If the acid is followed by water, MEMS that detect water can identify the fluid change and shift the tool to another corresponding position.

MEMS can also be used in permanently installed downhole valves that control the flow from one or more producing zones. As an example, consider a well with several oil or gas producing zones. Each of these zones is equipped with a "smart" valve that contains MEMS and the necessary components to control the valve position and thereby the flow of produced fluid from a particular zone. In this case two types of MEMS may be used, one type to detect the presence of hydrocarbons and another to detect the presence of water. When the MEMS indicate that the produced fluid is predominantly water, they cause the valve to close, shutting off the flow from the water-producing zones. The minute size of the MEMS, coupled with their low power requirements, make MEMS a viable method to control the operation of downhole tools and well completion apparatus, even without the use of a microprocessor and additional complex software.

Radio Frequency Tags

Passive radio frequency (RF) tags also provide a simple, efficient, and low cost method for sending information from the surface to a downhole tool. These tags are extremely robust and tiny, and the fact that they require no battery makes them attractive from an environmental standpoint. RF tags may be embedded in drop balls, darts, or other objects that may be pumped through coiled tubing and into a downhole tool. While the invention is not limited to RF tags for telemetry or drop balls for conveyance, the many advantages of tagged drop balls make them a preferred embodiment of the invention.

Radio Frequency Tag Functionality

RF tags are commercially available with a wide variety of capabilities and features. Simple "Read Only" (RO) tags emit a factory-programmed serial number when interrogated by a reader. A RO tag may be embedded in a drop ball and used to initiate a predetermined response from the reader. By programming the reader to carry out certain tasks based on all or a portion of a tag serial number, the RF tags can be used by the operator at surface to control a downhole tool.

In addition to RO tags, "Read/Write" (RW) tags are also available for use in internal telemetry for controlling operations of downhole tools and equipment of wells. These RW tags have a certain amount of memory that can be used to store user-defined data. The memory is typically re-programmable and varies in capacity from a few bits to thousands of bytes. RW tags offer several advantages over RO tags. For example, an operator may use a RW tag to send a command sequence to a tool. A single RW ball may be programmed to, for example, request both a temperature and a pressure measurement at specified intervals. The requested data may then be sent to the surface by another form of telemetry, such as an encoded pressure pulse sequence.

Furthermore, depending on the amount of memory available, the RW tag may effectively be used to re-program the tool. By storing conditional commands to tag memory, such as "If . . . Then" statements and "For . . . While" loops, relatively complicated instruction sets may be downloaded to the tool and carried out.

Radio Frequency Tag Readability

Because of the high flow rates and turbulent flow that typically occur in coiled tubing, special care must be taken to ensure a reliable and consistent read of each tag passing through a downhole tool. Any method, such as those described above, that is used to properly orient the tag, slow the velocity (linear and/or rotational) of the tag, or both, is within the scope of the invention.

Applications

From the standpoint of internal telemetry for downhole tool actuation, once the operator of a well has the ability to send information and instructions from the surface to one or more downhole tools, many new actions become possible. By giving a tool instructions and allowing it to respond locally, the difficulties associated with remote tool manipulation are minimized. Furthermore, by using internal telemetry to communicate with downhole tools, critical actions can be carried out more safely and more reliably.

The following is a brief description of some well applications to which the present invention can be applied to significant advantage. A condition for one to be able to use the internal telemetry elements of the present invention is that the tool string plus its conveyance means have the capability of circulating the telemetry elements downhole. For example, the present invention has particular application in conjunction with:

1. A downhole tool that has several operational modes, each needing to be controlled from the surface.
2. A downhole tool having several modes of operation that require control from surface, and tool manipulation between each mode also depends upon real time downhole information.
3. A downhole tool for which tool operation requires two-way communication between the surface and the downhole tool.

Tool Valves

A reliable valve is required in order to utilize internal telemetry with tagged drop balls for applications where the flow in the coiled tubing must be channeled correctly. The valve must be capable of holding and releasing pressure from above and below, as dictated by the tool and the application. Also, the valve must be operated (e.g. shifted) by the tool itself, not by a pressure differential or coiled tubing movement initiated from the surface. Consequently, the tool string requires a "Printed Circuit Board" (PCB) to control the motor that operates the valve, as well as battery power for operation of the motor.

Various types of valves, such as spool valves, are used today to direct an inlet flow to one or more of several outlets. However, these valves typically require linear motion to operate, which can be difficult to manage downhole due to the opposing forces from high pressure differentials. Furthermore, these valves also typically shift a sealing element, such as an o-ring, which makes them sensitive to debris, such as particulates that are inherent in the well fluid being controlled. Another challenge with using conventional valves is the limited space available in a typical downhole well tool, especially if multiple outlet ports are required.

The tool knowledge for well condition responsive valve or tool actuation is programmed in a downhole microcomputer. When the microcomputer receives a command from a telemetry element, it compares the real time pressures and temperatures measured from the sensors to the programmed tool knowledge, manipulates the valve system according to the program of the microcomputer, and then actuates the tool for sending associated pressure pulses to inform the surface or changes the tool performance downhole without sending a signal uphole.

Indexing Valve

Referring now to FIGS. 2, 2A, 2B and 2C, a downhole tool that is actuated according to the present invention may take the form of a motor operated indexing valve, shown generally at 36. The indexing valve has a valve housing 38 that defines a valve cavity or chamber 40 and an inlet passage 41 in communication with the valve chamber 40. The valve housing 38 also defines a motor chamber 42 having a rotary electric motor 44 located therein. The motor 44 is provided with an output shaft 46 having a drive gear 48 that is disposed in driving relation with a driven gear 50 of an indexer shaft 52 extending from an indexer element 54. The axis of rotation 53 of the indexer shaft 52 is preferably concentric with the longitudinal axis of the tool, though such is not required. Though only two gears 48 and 50 are shown to comprise a gear train from the motor 44 to an indexer element 54, it should be borne in mind that the gear train may comprise a number of interengaging gears and gear shafts to permit the motor to impart rotary movement at a desired range of motor force for controlled rotation of the indexer element 54.

As shown in FIGS. 2 and 2A–2C, the valve housing 38 defines a valve seat surface 56 which may have an essentially planar configuration and which is intersected by outlet passages 58, 60, 62, and 64. The intersection of the outlet passages with the valve seat surface is defined by valve seats, which may be external seats as shown at 66 or internal seats as shown at 68. Valve elements shown at 70, 71 and 72, urged by springs shown at 74 and 76, are normally seated in sealing relation with the internal and external valve seats. To open selected outlet valves, the indexer element 54 is provided with a cam element 78 which, at certain rotary positions of the rotary indexer element 54, will engage one or more of the outlet valve elements or balls, thus unseating the valve element and permitting flow of fluid from the inlet passage 41 and valve chamber 40 into the outlet passage. Thus, the indexing valve 36 is operated to cause pressure communication to selected inlet and outlet passages simply by rotary indexing movement of the indexer element 54 by the rotary motor 44.

The motorized indexing valve 36 of FIGS. 2 and 2A–2C is compact enough to operate in a downhole tool. Also, this valve is shifted with a rotation, not by linear movement, thereby eliminating the need for a pressure-balanced valve. The indexing valve 36 has two main features which arc exemplified by FIG. 2A. The first main feature of the indexing valve mechanism is a ball-spring type valve. The springs impose a force on each of the ball type valve elements so that, when the valve ball passes over an outlet port in the chassis, it will be popped into the respective port and will seat on the external seat that is defined by the port. If the indexer element 54 is held in this position, the valve ball will remain seated in the port due to the spring force acting on it. This type of valve is commonly referred to as a poppet, check, or one-way valve. It will hold pressure (and allow flow) from one direction only; in this case it will prevent flow from the inlet side of the port to the outlet side. If the indexer element 54 is rotated so that the valve ball is unseated, fluid flow will be permitted across the respective port and the pressure that is controlled by the indexing valve mechanism will be relieved and equalized. It should be noted that the spring elements, though shown as coil type compression springs, are intended only to symbolize a spring-like effect that may be accomplished by a metal compression spring, or a non-metallic elastic material, such as an elastomer.

The second main feature of the indexing valve 36 is a cam-like protrusion 78 that is a rigid part of the indexer element 54. The cam 78 serves to unseat a ball-spring valve in the chassis that is designed to prevent flow from the outlet passage side 62 of the port to the inlet side, which is defined by the inlet passage 41 and the valve cavity or chamber 40. Therefore, if the cam 78 is acting on the ball 72, the pressure across this port will be equalized and fluid will flow freely in both directions. If the indexer element 54 is in a such a position that the cam 78 does not act on the ball 72, the ball 72 will be seated by the spring force and will have sealing engagement with the port. When this happens, the pressure in the corresponding outlet will always be equal to or greater than the pressure on the inlet side.

The transverse sectional view of FIG. 2B shows that multiple outlets, for example 58, 60, 62, and 64, may be built into the valve chassis 38. These outlets may be designed, in conjunction with the indexer element 54, to hold pressure from above or below. By rotating the indexer element 54, an example of which is shown in FIG. 2C, the valves may be opened or closed individually or in different combinations, depending on the desired flow path(s).

An important feature of the indexer element 54 is its multiple "arms", or "spokes" 55, with the spaces between the spokes defining flow paths between the valve chamber 40 and the outlet passages 58, 60, 62, 64. This feature allows fluid to flow easily around the arms or spokes 55, which in turn keeps the valve area from becoming clogged with debris. The indexer element 54 of FIG. 2C is T-shaped, but it should be borne in mind that the indexer element may be Y-shaped, X-shaped, or whatever shape is required to allow for the proper number and placement of the various ball-spring valves and cams. Substantially solid indexer elements may be employed, assuming that openings are defined that represent flow paths.

It should also be noted that the cams and ball-spring valves need not lie at the same distance from the center of the chassis 38. In other words, the placement of the ball-spring valves and cams could be such that, for example, the indexer element 54 could rotate a full 360 degrees and never have a ball-spring valve in the indexer element pass over (and possibly unseat) a ball-spring valve in the chassis or housing 38.

Finally, it is important to realize that the system shown in FIG. 2 is not intended to limit the scope of the invention to a particular arrangement of components. For example, the motor might have been placed coaxially with the indexer element, and more or less outlets could have been shown at different positions in the chassis. These variations do not alter the purpose of the indexing valve of the present invention, which is to control the flow of fluid from one inlet, the inlet passage 41 and valve chamber 40 to multiple outlets 58, 60, 62, 64. Furthermore, each ball-spring valve is an example of a mechanism to prevent fluid flow in one direction while restricting fluid flow in the opposite direction and when one or more spring-urged valve balls are unseated, to permit flow, such as for permitting packer deflation. Though one or more cam projections are shown for unseating the valve balls of the ball-spring valves; other methods used to accomplish this feature are also within the spirit scope of the invention. The cam type valve unseating arrangement that is disclosed herein is but one example of a method for unseating a spring-urged mechanism that only allows one-way flow.

Inflatable Straddle Packers

The present invention is effective for use in connection with inflatable straddle packers, such as shown in FIG. 3, in well casing perforation systems, well completion systems, and valves or other fluid flow control systems for well equipment and downhole tools. Certain downhole tools, such as inflatable packers, require the fluid flow through the coiled tubing to be directed into different ports at different stages in the operation. This has been accomplished by using a mechanical shifting mechanism that opens and closes the ports depending on how the coiled tubing is pushed and pulled from surface. If the packer is used with an internal telemetry device, such as an RF tag reader, the mechanical shifting system can be replaced with a valve system, such as an indexing valve, that is controlled by the tool in response to instructions conveyed to the tool by one or more internal telemetry elements. The operator can then send internal telemetry elements such as tagged drop balls from the surface that correspond to desired valve positions. Furthermore, a telemetry tool, if also in the tool string, can send pressure pulses to surface to verify that the ball has been received and its instructions detected and that the instructed action has been carried out correctly.

Tool Knowledge and Logic

A straddle packer tool embodying the principles of the present invention has three modes, "inflate/deflate", "circulate", and "inject". The wellbore pressure, dynamic pressures, and temperatures that are present in the downhole environment, will affect each of these modes differently.

The packer pressure is the most important pressure because the differential pressure across the packer wall cannot exceed a predetermined maximum, $P_M$. The maximum differential pressure $P_M$ is dependent upon expansion ratio, packer size, and temperature. The maximum differential pressure $P_M$ can occur either from the inside of the packer to the wellbore or from the inside of the packer to the zone being straddled for injection. The packer pressure, after the packer has been set, will change due to changes in wellbore pressures, injection pressures, and temperatures. Therefore, it is very important for the operator at the surface to know real time pressures and temperatures and check constantly during the job to see whether the packer pressure exceeds the maximum differential pressure.

Referring now to the diagrammatic illustration of FIG. 3, a well is shown at 80 having a well casing 82 extending to a zone to be treated with injection fluid, such as for fracturing of the formation of the zone, by injecting fluid through perforations in the casing at the zone. An injection tubing 84, which may be jointed tubing or coiled tubing extends through the casing to a straddle packer tool shown generally at 86. As mentioned above, it is highly desirable to ensure accurate measurement of various downhole well parameters, such as formation temperature and pressure, bottom hole temperature and pressure, injection fluid temperature and pressure, as well as packer temperature and pressure. To accomplish these features according to the principles of the present invention, the straddle packer tool 86 is provided with spaced inflatable packer elements 88 and 90 each having temperature and pressure sensors 92 and 94 for measurement of bottom hole temperature and pressure above and below the straddle packer. The straddle packer tool 86 is also provided with a temperature and pressure sensor 93 for detecting the temperature and pressure of the injection fluid that is present in the interval between the packer elements and for detecting the temperature and pressure of formation fluid that might be present in the interval.

The injection tubing 84 defines an internal passage that serves as an injection fluid passage, but also serves as a conveyance passage for one or more telemetry elements or a telemetry fluid having specific chemical characteristics. The straddle packer tool 86 includes a tool chassis structure of the general nature shown at 12 in FIG. 1, with a detector located for detection of identification and instruction codes of a telemetry element that is run downhole through the tubing for controlling actuation of the packer responsive to the temperature and pressure conditions that are sensed. If desired, the straddle packer 86 may have an associated pressure pulse telemetry tool that transmits temperature and pressure signals to the surface in the form of pressure pulses. Also, if desired, the telemetry element may have a read/write capability to permit data representing temperature and pressure measurements to be recorded thereby for subsequent downloading to a computer at the surface.

For inflatable straddle packer tools embodying the principles of the present invention, such as shown in FIG. 3, (using a Type I telemetry element (ball)), the general procedure or steps that are required for well tool operators at the surface are as follows:

Run in Hole: Typically a straddle packer tool 86 is run into the hole (RIH) with all of its ports (valves) open and during pumping of fluid through the tubing at a predetermined flow rate, if fluid circulation is required during RIH.

Set: After the straddle packer tool has reached its proper installation depth, the tool is actuated to accomplish setting of the tool. To accomplish setting of the tool the operator will circulate a "SET" ball downhole and land the "SET" ball on or in the tool or pass the "SET" ball through the detection chamber 26 of the tool chassis 12 of FIG. 1 to permit data communication between the ball and the detector and microcomputer of the packer tool.

When first receiving "Ball Landed" pressure pulses, the operator will initiate pumping of fluid through the tubing to inflate the packer according to the packer inflation procedure. During this procedure the operator will watch the circulation pressure. A change in circulation pressure may be seen when closing the inflation port and opening the circulation port of the packer. When receiving a "Packer Set" pressure pulse, the operator will cease pumping or change the flow rate of the fluid being pumped.

Spot: The operator will then pump fluid through the tubing at a designed flow rate for spotting inflation fluid if necessary.

Injection: The operator will then circulate an "INJECTION" ball downhole. When first receiving "Ball Landed" pressure pulses, the operator will start pumping injection fluid according to the job design. The operator will closely watch the injection pressure. A change in the circulation pressure may be seen when closing the injection port and opening the circulation port of the straddle packer tool. When receiving "Injection done" pressure pulses, the operator will stop injection fluid pumping or will change the flow rate of the injection fluid.

Spot: The operator will then pump the injection fluid at a designed flow rate for spotting the treatment fluid if necessary.

Unset: After fluid injection has been completed according to plan, it will be desirable to unset the packer so that it can be retrieved from the well or positioned at a different well depth for treatment of a different zone for which casing perforations have been formed. To accomplish unsetting of the packer according to the principles of the present invention, the operator will then circulate an "UNSET" ball downhole and will receive "Ball Landed" pressure pulses when the "UNSET" ball has reached the detector of the tool. The "UNSET" telemetry element or ball is provided with programmed instructions that are recognized by the detector and microcomputer of the tool.

The operator will receive "Deflating" pressure pulses during deflation of the packer and when the packer deflation procedure has been completed, will receive "Deflated" pressure pulses. After having received "Deflated" pressure pulses, the operator can then initiate movement of the packer to another desired zone within the well or retrieve the straddle packer from the well.

In the event emergency conditions should be detected that make it appropriate to retrieve the packer from the well or at least unseat the packer, the operator will circulate an "UNSET" ball downhole, causing the valve mechanism to be operated according to the procedure that is described above for deflating the packer in response to instructions of the telemetry element or ball that are sensed and processed by the detector and microcomputer of the packer tool. If a ball cannot be circulated downhole, an emergency unset mechanism will also be available by a mechanical means.

If real time downhole temperatures are needed during the job at the surface, the operator can circulate a "BHT" ball downhole to the detector of the tool. Signals representing temperature measurement are received by the downhole temperature sensors, as shown in FIGS. 1B and 3, and the downhole tool will respond by transmission of a series of pressure pulses with encoded real time temperature information.

If real time downhole pressures are needed at the surface during the job, the operator can circulate a "BHP" ball downhole, and will receive a series of pressure pulses with various real time encoded pressure information. Under conditions where both temperature and pressure are needed by the operator for carrying out a downhole procedure, a telemetry element, such as a ball which is encoded with temperature and pressure instructions, is sent downhole so that the downhole tool can provide a series of pressure pulses representing real time temperature and a series of pressure pulses representing real time downhole pressure at the tool.

The "general logic" of the internal telemetry system of the present invention is shown in the logic diagram of FIG. 4. It should be borne in mind that the logic diagrams make reference to the straddle packer arrangement and temperature and pressure sensing of FIG. 3. The logic is illustrated in "yes"/"no" form. If a telemetry element, i.e. "ball", is detected by the detector of the system, regardless of its character, the logic is changed from "No" to "Yes", causing the pulse telemetry system of the tool to transmit pressure pulses through the fluid column to the surface to confirm that the ball has been detected. The actual measured temperatures and pressures are then compared with programmed temperatures and pressures and a pulse signal "Temperature exceeded" or "Pressure exceeded" is sent to the surface in the event the measured temperatures and pressures exceed the programmed temperatures and pressures. If the measured temperatures and pressures are confirmed to be within the programmed range, signals are conducted to the valve mechanism by the microcomputer to shift the valve mechanism of the packer to its initial mode in preparation for setting and injection. Depending upon the difference of interval pressure $P_i$ as compared with a preset interval pressure $P_{i,preset}$, the related port is closed and the circulation port is opened, and pressure pulses so indicating are sent to the surface.

The "SET" logic of the internal telemetry system of the present invention as it applies to straddle packers is shown in FIG. 5. Once a "SET" ball telemetry element has been received downhole, if the measured temperature downhole T is greater than the maximum programmed temperature $T_M$, the packer control system will not function and the pulse telemetry system will send "Temperature Exceeded" pulse signals to the surface in confirmation. If the measured temperature T is within the proper range, the valve mechanism of the packer will be operated to open the inflation ports, with the packer elements being inflated sequentially to a pressure $P_1$. As long as the pressure measurements are proper, that is the inflate pressure $P_1$ is less than packer design inflate pressure $P_{packer}$, packer inflation will continue until the packer has been set within the well casing, after which the circulation port is opened and the inflation port is closed, and pressure pulses confirming this are sent to the surface.

The "INJECTION" logic is shown in the logic diagram of FIGS. 6A and 6B. According to the present invention the injection procedure is initiated by sending an "INJECTION" telemetry element or ball from the surface through the tubing string, with detection of the ball being confirmed by fluid pulse telemetry to the surface. With the continuously acquired temperature and pressure measurements compared with programmed parameters and resolved acceptably for continuing the injection procedure, injection valve manipulation occurs and pumping of injection fluid is initiated. Injection of treatment fluid into the interval between the packer elements, such as for formation fracturing, will continue as long as the measured temperatures and pressure remain within design parameters. Pressure pulse signals will be transmitted to the surface to confirm the completion of injection.

The "UNSET" logic of FIG. 7 will be initiated after the injection job has been completed. The "UNSET" procedure, according to the present invention, is initiated by sending an "UNSET" telemetry element or ball through the tubing to the downhole location of the packer for detection of its identification and instruction tags. Landing of the ball in detecting proximity with the detector of the straddle packer tool is confirmed by fluid pulse telemetry. At this time, since landing of the ball has been confirmed, the injection port and the inflation port of the packer actuating mechanism will be opened, thus permitting deflation of the packer elements to occur. If the packer pressure $P_1$ is greater than casing pressure $P_{casing}$ at the depth of the packer, deflation of the packer elements will be continued. If the packer pressure is equal to the casing pressure at the depth of the packer, the "UNSET" procedure of the packer will have been completed and the packer tool will send "Deflated" pressure pulses to the surface as confirmation. At this point the packer may be retrieved from the well casing or moved to another depth to conduct another formation treatment procedure.

It should be borne in mind that the logic diagrams of FIGS. 4–7 are representative of a preferred embodiment of the present invention as it applies to straddle packers, but are not intended to be considered restrictive of the scope of this invention in any manner whatever. The salient feature of downhole packer actuation utilizing the principles of the present invention is the use of internal telemetry elements, in this case "balls" having instruction tags that permit the operator of the well to control packer setting, actuation, and unsetting from the surface. Additionally, the logic of the program of the microcomputer of the packer tool permits packer actuation to also be responsive to real time measurements of temperature and pressure in the downhole environment.

Perforation

Casing perforating is another application of the internal telemetry of the present invention. The decision of when and where to perforate is based on many factors. Accidental or untimely firing of the shaped explosive charges of a perforation gun can result in serious losses. Personal injury and damage to well equipment can result from inadvertent firing of a perforation gun before it is run into the well casing. If a perforation gun is fired in the casing, but at the wrong depth, serious damage to the well casing and other equipment can result, at times requiring abandonment of the well. Internal telemetry may be used to acquire data, such as downhole temperature and pressure measurements, that better equip the operator to decide when to fire the shaped charges of a perforation gun. Internal telemetry may also be used to send the "Perforate" signal from the surface to cause firing of the perforation gun of the tool. This feature of the present invention provides a failsafe mechanism for initiation of the perforating process only after the operator of the well equipment has confirmed the acceptability of all downhole paramaters. For instance, the perforation gun tool may be programmed so that it simply will not perforate unless it identifies the serial number of the RF tag in the "perforating" telemetry element or drop ball. Also, if the internal telemetry system is used with a pressure pulse telemetry tool as mentioned above, a pressure pulse sequence may be sent to the surface to indicate that all parameters for perforation have been met, and after firing of the perforating gun, that the perforating operation was carried out successfully.

When the tubing conveyed perforation (TCP) gun reaches the predetermined depth, the information of the gun orientation becomes very important in addition to temperature and pressure in some cases. It is possible to control and adjust the gun orientation at the surface. However, due to unknown tubing rotation during running of the TCP gun into the borehole, it is important to know the actual gun orientation at the depth of the intended perforations.

In order to have this real time information, a Type III telemetry element may be used, which, as explained above, has one or more embedded sensors for detection of downhole conditions. This Type III telemetry element will have an orientation sensor embedded therein to detect the actual orientation of the TCP gun at depth. If the gun is not properly oriented its orientation may be adjusted and verified by the orientation sensor of the telemetry element. The TCP gun can transmit as a series of pulses to the surface when proper orientation of the gun has been confirmed. The general procedure for a TCP gun with pressure-induced firing is as follows:

1. A TCP gun having a programmed downhole computer is run into the hole, with fluid circulation being provided during the running procedure if necessary.
2. After the TCP gun has reached the desired depth for casing perforation its downhole movement is stopped. At this point, firing of the TCP gun will accomplish perforation of the well casing, thus permitting the well to be completed. When TCP gun movement has stopped, a Type III telemetry element is pumped or otherwise moved downhole into close proximity or engagement with the detector of the downhole computer of the TCP gun. The downhole computer then signals the downhole equipment to send "Ball Landed" pressure pulses to the surface after the Type III telemetry element lands. Should the telemetry element detect a preset gun orientation, the telemetry element will issue the command that corresponds to firing of the gun, thereby initiating the shaped charges and perforating the casing. If the desired orientation of the perforating gun is not detected, the microcomputer will send "Not Oriented" pressure pulses to the surface, thereby permitting downhole orientation or alignment of the TCP gun to be accomplished.

The telemetry elements may also be used as a trigger operation to accomplish firing of the TCP gun or to prevent its firing if all of the programmed conditions have not been met. The TCP gun will not fire until the telemetry element lands or until it detects a preset value that can only occur when the TCP gun is located at the proper depth and properly oriented, is stationary within the wellbore, and has been maintained static within the well casing and properly oriented for a predetermined period of time sufficient to verify readiness of the gun for firing.

Completions

Current intelligent completions use a set of cables to monitor downhole production from the downhole sensors that have been built into the completion, and to control downhole valve manipulations. The reliability of these cables is always a concern. Using a Type III telemetry element allows the operator to have a wireless two-way communication to monitor downhole production, to perform some downhole valve operations when the tool detects a predetermined situation, and sends back signal pressure pulses to the surface.

For example, as shown diagrammatically in FIG. 8, a well 80 has a well casing 82 extending from the surface S. Though the wellbore may be deviated or oriented substantially horizonally. FIG. 8 is intended simply to show well production from a plurality of zones. Oil is being produced from the first and third zones as shown, but the second or intermediate zone is capable of producing only water and thus should be shut down. Production tubing 83 is located within the casing and is sealed at its lower end to the casing by a packer 85. The well production for each of the zones is equipped with a packer 87 and a valve and auxiliary equipment package 89. The valve and auxiliary equipment package 89 is provided with a power supply 89*a*, such as a battery, and includes a valve 89*b*, a telemetry element detector and trigger 89*c* for actuating the valve 89*b* in response to the device (water) sensor 89*d* and controlling flow of fluid into the casing. As shown in FIG. 8, the intermediate valve in the multi-zone well should be closed because of high water production. According to the principles of the present invention, the operator of the well can pump a Type III telemetry element downhole having a water sensor embedded therein. Since the telemetry element detector will not be able to trigger action until the telemetry element detects a preset water percentage, the only zone that will be closed is the zone with high water production. The other zones of the well remain with their valves open to permit oil production and to ensure minimum water production.

Referring now to FIGS. 9–14, a side pocket mandrel shown generally at 90 may be installed within the production tubing at a location near each production zone of a well. The side pocket type battery mandrel has an internal orienting sleeve 92 and a tool guard 93 which are engaged by a running tool 94 for orienting a kick-over element 96 for insertion of a battery assembly 98 into the side pocket 100, i.e., battery pocket of the mandrel 90. The battery assembly 98 is provided with upper and lower seals 102 and 104 for sealing with upper and lower seal areas 103 and 105 on the inner surface of the battery pocket 100 and thus isolating the battery 106 from the production fluid. The mandrel further includes a valve 107, which may conveniently take the form of an indexing valve as shown in FIGS. 2, 2A, 2B, and 2C and has a logic tool 109 which is preferably in the form of a microcomputer that is programmed with the logic shown in the logic diagrams of FIGS. 4–7. The battery assembly 98 also incorporates a latch mechanism 108 that secures the battery assembly within the battery pocket 100. Thus, the battery assembly 98 is deployed in the side pocket of the battery mandrel 90 in a manner similar to installation of a gas lift valve in a gas lift mandrel.

Figure 11:
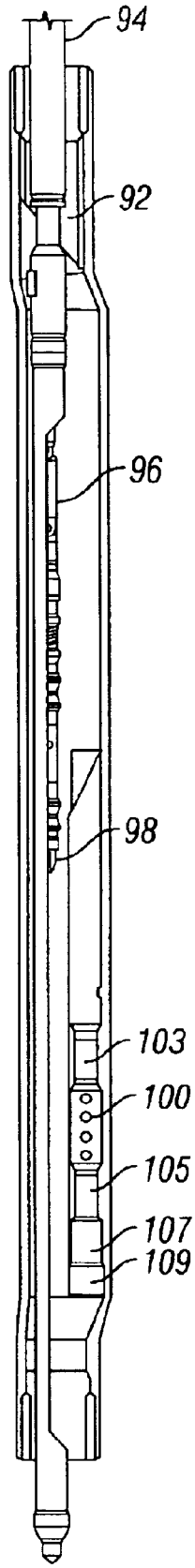
Figure 12:
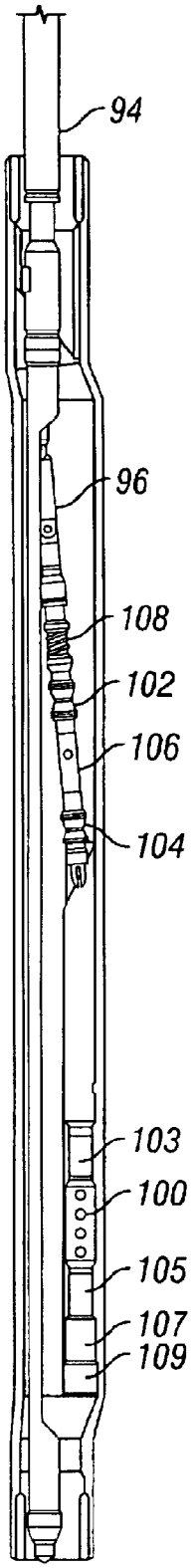
Figure 13:
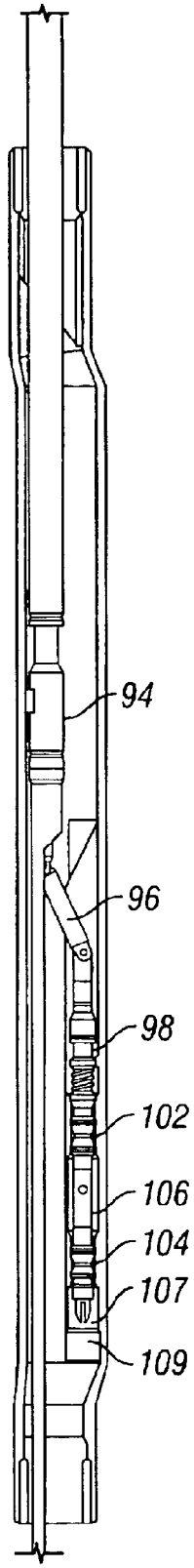
Figure 14:
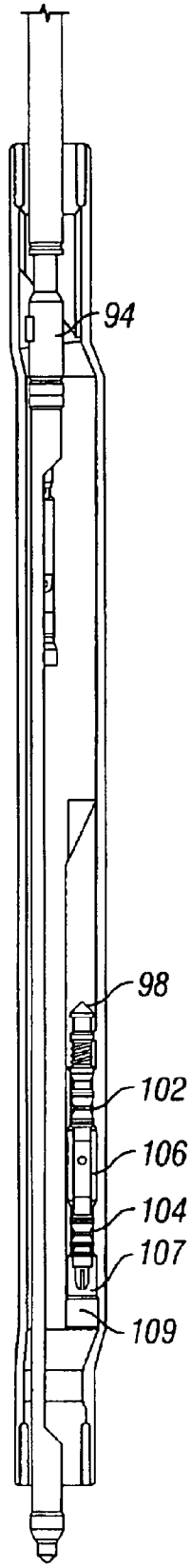

The sequence for battery installation in a side pocket mandrel is shown in FIGS. 11–14. Retrieval of the battery assembly 98 for replacement or recharging is a reversal of this general procedure. As shown in FIG. 11, the orienting sleeve 92 enables the battery 106 to be run selectively. In this case, the battery 106 is being run through an upper battery mandrel to be located within a mandrel set deeper in the completion assembly. As shown in FIG. 12, the orienting sleeve 92 activates the kick-over element 96 to place its battery 106 in a selected battery pocket 100. FIG. 13 shows the battery assembly 98 fully deployed and latched within the battery pocket 100 of the mandrel 90. FIG. 14 illustrates the running tool 94 retracted and being retrieved to the surface, leaving the battery assembly 98 latched within the battery pocket 100 of the mandrel 90.

A downhole completion component such as those described may be powered by a replacable battery (replaced using slickline or wireline), a rechargable battery, sterling engine-operated generator, or a turbine-driven generator having a turbine that is actuated by well flow.

One embodiment of the present invention, which has specific application for well completions, utilizes a small RF tag, read/write capable telemetry element (ball) that is dropped or conveyed downhole in an open completion with information programmed therein and then brought back to the surface with the same or different information so that the information can be downloaded to a computer. According to another method, the well is choked to stop flow and a telemetry element having an RF tag and having a specific gravity slightly higher than well fluid is caused to descend into the well to the downhole tool or other equipment that is present within the well. This telemetry element will descend through the liquid column of the well at a velocity that will enable the data of the RF tag to be accurately detected and the representative signal thereof to be processed by the microcomputer and used for controlling downhole activity of well tools or equipment. Also, downhole data, such as temperature and pressure, is electronically written to the telementry element. After completion of the downhole descent and data interchange, the telemetry element is brought back to the surface by flowing the well to cause ascent of the RF tag telemetry element. Alternatively, a telemetry element may be sunk within the fluid column of the well by sinking weights or descent ballast. When it is desirable to cause ascent of the telemetry element to the surface, the ballast or weights may be released or dropped either by opening a small ballast trap door or dissolving a ballast retainer (which is timed to dissolve in well fluids after a certain duration). The RF tag telemetry element passes by a RF capable completion component that reads the contents of the RF tag and writes back some information (perhaps downhole temperature, pressure, density, or valve position). The same tag may pass by multiple completion components or a single completion component, depending upon the characteristics of the completion equipment. Some completion components may also choose to capture the tagged telemetry element and hold it (for example by means of magnetic attraction or a mechanical device). Information being sent downhole for controlling operation of downhole tools may include features such as program sequence instructions, valve positions, desired flow rates, and telemetry initiate and terminate commands. The information being sent uphole may include features such as results of telemetry, program sequence verification, actual valve positions, and flow rates.

As will be readily apparent to those skilled in the art, the present invention may easily be produced in other specific forms without departing from its spirit or essential characteristics. The present embodiment is, therefore, to be considered as merely illustrative and not restrictive, the scope of the invention being indicated by the claims rather than the foregoing description, and all changes which come within the meaning and range of equivalence of the claims are therefore intended to be embraced therein.

We claim:

1. A method for controlling operation of a downhole apparatus in a well responsive to identification codes conveyed from the surface, comprising:

providing a tubing string in the well having a conveyance passage therein;

providing downhole a detector in communication with said conveyance passage for receiving telemetry element identification codes, and a processor for receiving and processing telemetry element identification codes and having at least one control signal output for controlling operation of said downhole apparatus;

moving a telemetry element having at least one identification code through said conveyance passage from the surface into communication proximity with said detector, wherein the telemetry element is a fluid having a specified property representing an identification code;

processing said at least one identification code of said telemetry element by said processor and providing at least one control signal output based on a preprogrammed response corresponding to said at least one identification code; and selectively controlling at least one downhole well operation with said at least one control signal output, wherein said detector has the capability of sensing said specified property and generating signal responsive thereto.

2. The method of claim 1, wherein said telemetry element further comprises a radio frequency tag.

3. The method of claim 1, wherein said telemetry element further comprises a radioactive tag.

4. The method of claim 1, wherein said telemetry element further comprises a magnetic material.

5. The method of claim 1, wherein said telemetry element further comprises a micro-electro mechanical system (MEMS).

6. The method of claim 2, further comprising:

writing downhole data to said telemetry element; and conveying said telemetry through said conveyance passage of said tubing string to the surface; and downloading downhole data from said telemetry element.

7. The method of claim 1, wherein:

said fluid having a specified property further composing a trace element, the element representing an identification code; and said detector has the capability of sensing said trace element and generating a signal responsive thereto.

8. A method for controlling operation of a downhole apparatus in a well responsive to identification codes conveyed from the surface, comprising:

providing a tubing string in the well having a conveyance passage therein;

providing downhole a detector in communication with said conveyance passage for receiving telemetry element identification codes, and a processor for receiving and processing telemetry element identification codes and having at least one control signal output for controlling operation of said downhole apparatus;

moving a telemetry element having at least one identification code through said conveyance passage from the surface into communication proximity with said detector, wherein the telemetry element is a chemical contained in said fluid, said chemical representing an identification code;

processing said at least one identification code of said telemetry element by said processor and providing at least one control signal output based on a preprogrammed response corresponding to said at least one identification code; and selectively controlling at least one downhole well operation with said at least one control signal output, wherein said detector has the capability of sensing said chemical and generating a signal responsive thereto.

9. The method of claim 2, wherein said telemetry element is of read/write character and is programmed with a plurality of operation codes and said downhole apparatus, responsive to said identification code, communicates downhole conditions to said telemetry element, said method further comprising:

communicating at least one well condition signal from said detector to said telemetry element; and detecting operation codes of said telemetry element corresponding to said at least one well condition signal; and operating said downhole apparatus responsive to said corresponding operation codes and said at least one well condition signal.

10. A universal fluid control system for wells, comprising:

a tubing string extending from surface equipment to a desired depth within a well and defining a conveyance passage;

a downhole tool adapted for positioning at a selected depth within the well and having a telemetry passage in communication with said conveyance passage;

a telemetry data detector located for acquisition of data associated with said downhole tool;

a microcomputer coupled with said telemetry data detector and programmed for processing telemetry data and providing downhole tool control signals; and at least one telemetry element of a dimension for passing through said conveyance passage and having an identification code recognizable by said telemetry data detector for processing by said microcomputer for causing said microcomputer to communicate control signals to said downhole tool for operation thereof responsive to said identification code, further comprising a telemetry element velocity control system located within said telemetry passage and having the capability of slowing the velocity of movement of said at least one telemetry element and rotating said at least one telemetry element through said telemetry passage.

11. The universal fluid control system of claim 10, wherein:

said tubing string is a coiled tubing string; and said at least one telemetry element is of a configuration for passing through said conveyance passage of said coiled tubing string to detecting proximity with said telemetry data detector.

12. The universal fluid control system of claim 10, wherein said at least one telemetry element passes through said conveyance passage by gravity descent.

13. The universal fluid control system of claim 10, wherein said at least one telemetry element is transported through said conveyance passage by fluid flowing through said tubing string.

14. The universal fluid control system of claim 10, wherein:

said at least one telemetry element is read/write programmable for data communication to and from surface equipment and to and from said downhole tool; and said at least one telemetry element is transported through said conveyance passage to and from said downhole tool by fluid flow through said tubing string.

15. The universal fluid control system of claim 10, wherein said velocity control system comprises obstructions located within said telemetry passage so as to form a helical passage therethrough.

16. The universal fluid control system of claim 10, wherein said telemetry passage runs in parallel with said conveyance passage and said conveyance passage is of a dimension smaller than said at least one telemetry element where said conveyance passage and said telemetry passage separate from one another.

17. The universal fluid control system of claim 10, said velocity control system comprising internal projections located within said telemetry passage, said internal projections oriented to change substantially linear movement of said at least one telemetry element to non-linear movement.

18. The universal fluid control system of claim 10, wherein said velocity control system comprises a plurality of elastic projections located within said telemetry passage.

19. The universal fluid control system of claim 10, wherein:

said downhole tool comprises a tool chassis defining an internal detector chamber in communication with said conveyance passage and having said telemetry data detector therein, said detector chamber having a greater internal cross-sectional dimension than the dimension of said at least one telemetry element and said tool chassis defining a flow passage past any telemetry element located within said detector chamber; and at least one velocity retarding element is located within said detector chamber for retarding movement of said at least one telemetry element within said detector chamber.

20. The universal fluid control system of claim 10, wherein said velocity control system comprises an obstruction in said telemetry passage, and wherein said obstruction is actuated for selective withdrawal from said telemetry passage.

21. The universal fluid control system of claim 10, wherein said velocity control system comprises a restriction in the area of said telemetry passage.

22. The universal fluid control system of claim 10, wherein said at least one telemetry element is disposable within the well.

23. A universal fluid control system for wells, comprising:

a coiled tubing string extending from the surface downhole within a well and defining a conveyance passage;

a well tool for downhole operation having a tool chassis defining an internal passage in communication with said coiled tubing;

a telemetry element having an identification code and being of a dimension for passing through said conveyance passage and into said internal passage; and a code detector/processor positioned for sensing and processing an identification code of said telemetry element when said telemetry element is in code detecting proximity therewith and providing a control signal to said well tool for operation of said well tool in response to said identification code, further comprising a velocity control system located within said internal passage and having the capability of slowing the velocity of movement of said telemetry element and rotating said telemetry element through said internal passage.

24. The universal fluid control system of claim 24, wherein:

said telemetry element has an instruction code in addition to said identification code; and said code detector/processor detects said instruction code and provides said control signal to said well tool only after having recognized said identification code.

25. The universal fluid control system of claim 23, said velocity control system comprising:

structure within said internal passage changing the direction of movement of said telemetry element from linear to non-linear for reducing the velocity of movement of said telemetry element.

26. The universal fluid control system of claim 23, wherein said telemetry element is of smaller dimension than the cross-sectional dimension of said conveyance passage to permit movement of said telemetry element through said conveyance passage to said well tool and has a ballast causing the specific gravity of said telemetry element to cause descent of said telemetry element in fluid within said conveyance passage, said ballast being releasable from said telemetry element to reduce the specific gravity of said telemetry element and permit ascent of said telemetry element within said conveyance passage to the surface.

27. A method of conveying information in a well, comprising:

providing a tubing string in the well having a conveyance passage communicating with a downhole apparatus, said downhole apparatus comprising a detector for receiving telemetry element identification codes, a processor fur receiving and processing telemetry element identification codes and producing a telemetry signal output, and a telemetry signaling apparatus;

moving a telemetry element having at least one identification code through said conveyance passage from the surface into communication proximity with said detector, wherein the conveyance passage comprises an internal passage capable of reducing the velocity of movement of said telemetry element;

processing said at least one identification code of said telemetry element by said processor and providing at least one telemetry signal output to said telemetry signaling apparatus in response to said at least one identification code; and said telemetry signaling apparatus sending a signal to the surface in response to said telemetry signal output.

28. The method of claim 27, wherein said telemetry signaling apparatus is a pressure pulse telemetry system and said signal to the surface is a pressure pulse in a fluid within said conveyance passage.

29. The method of claim 27, wherein said downhole apparatus further comprises at least one downhole sensor, said method further comprising:

providing an output from said downhole sensor to said processor, said signal to the surface corresponding to the output of said downhole sensor.

30. The method of claim 29, wherein said downhole sensor is a temperature sensor.

31. The method of claim 29, wherein said downhole sensor is a pressure sensor.

32. A method of communicating with a downhole apparatus in a well, comprising:

providing a tubing string in the well having a conveyance passage communicating with said downhole apparatus, said downhole apparatus comprising a detector for receiving information from a telemetry element and a processor for receiving and processing telemetry element information;

moving a telemetry element having a program code through said conveyance passage from the surface into communication proximity with said detector; the conveyance path comprising a velocity control system capable of reducing the velocity of the telemetry element and processing said program code by said processor such that said processor is programmed by said code.

33. The method of claim 32, wherein said program code includes at least one conditional command.

34. The method of claim 32, wherein said telemetry element comprises a read/write radio frequency tag.

35. The method of claim 32, wherein said programming of said processor comprises re-programming said processor.

36. A method of conveying information in a well, comprising:

providing a tubing string in the well having a conveyance passage therein; providing a downhole apparatus in the well, said downhole apparatus capable of storing data therein;

moving a telemetry element through said conveyance passage from the surface into communication proximity with said downhole apparatus;

providing a telemetry element velocity control system having the capability of causing the moving telemetry element to rotate;

recording data from said downhole apparatus in said telemetry element; and returning said telemetry element to the surface by fluid flow through said conveyance passage.

37. The method of claim 36, further comprising downloading the recorded data from said telemetry element at the surface.

38. The method of claim 36, wherein said telemetry element is a radio frequency tag.

* * * * *